US007026104B2

(12) United States Patent
Nariyuki

(10) Patent No.: US 7,026,104 B2
(45) Date of Patent: Apr. 11, 2006

(54) HEAT-DEVELOPABLE PHOTOSENSITIVE MATERIAL AND METHOD OF FORMING IMAGES

(75) Inventor: Fumito Nariyuki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/374,046

(22) Filed: Feb. 27, 2003

(65) Prior Publication Data

US 2003/0194667 A1 Oct. 16, 2003

(30) Foreign Application Priority Data

Feb. 28, 2002 (JP) ..... P.2002-053890

(51) Int. Cl.
*G03C 1/498* (2006.01)
*G03C 5/16* (2006.01)

(52) U.S. Cl. ..... 430/350; 430/531; 430/533; 430/536; 430/567; 430/600; 430/613; 430/619; 430/965

(58) Field of Classification Search ..... 430/619, 430/567, 350, 965, 600, 613, 531, 533, 536
See application file for complete search history.

(56) References Cited

U.S. PATENT DOCUMENTS

| | | | | | |
|---|---|---|---|---|---|
| 4,332,889 | A | * | 6/1982 | Siga et al. | 430/583 |
| 4,672,026 | A | * | 6/1987 | Daubendiek | 430/495 |
| 5,698,380 | A | * | 12/1997 | Toya et al. | 430/619 |
| 5,891,616 | A | * | 4/1999 | Gilliams et al. | 430/619 |
| 5,998,126 | A | * | 12/1999 | Toya et al. | 430/619 |

* cited by examiner

*Primary Examiner*—Thorl Chea
(74) *Attorney, Agent, or Firm*—Sughrue Mion, PLLC

(57) ABSTRACT

A heat-developable photosensitive material comprising on a support light-sensitive silver halide, a light-insensitive organic silver salt, a reducing agent and a binder, wherein at least 30 mole % of the total light-sensitive silver halide is silver halide of high silver iodide content having an average γ-phase proportion of from 5 to 70 mole %, and a method of forming images on the heat-developable photosensitive material with a semiconductor laser.

6 Claims, 1 Drawing Sheet

FIGURE
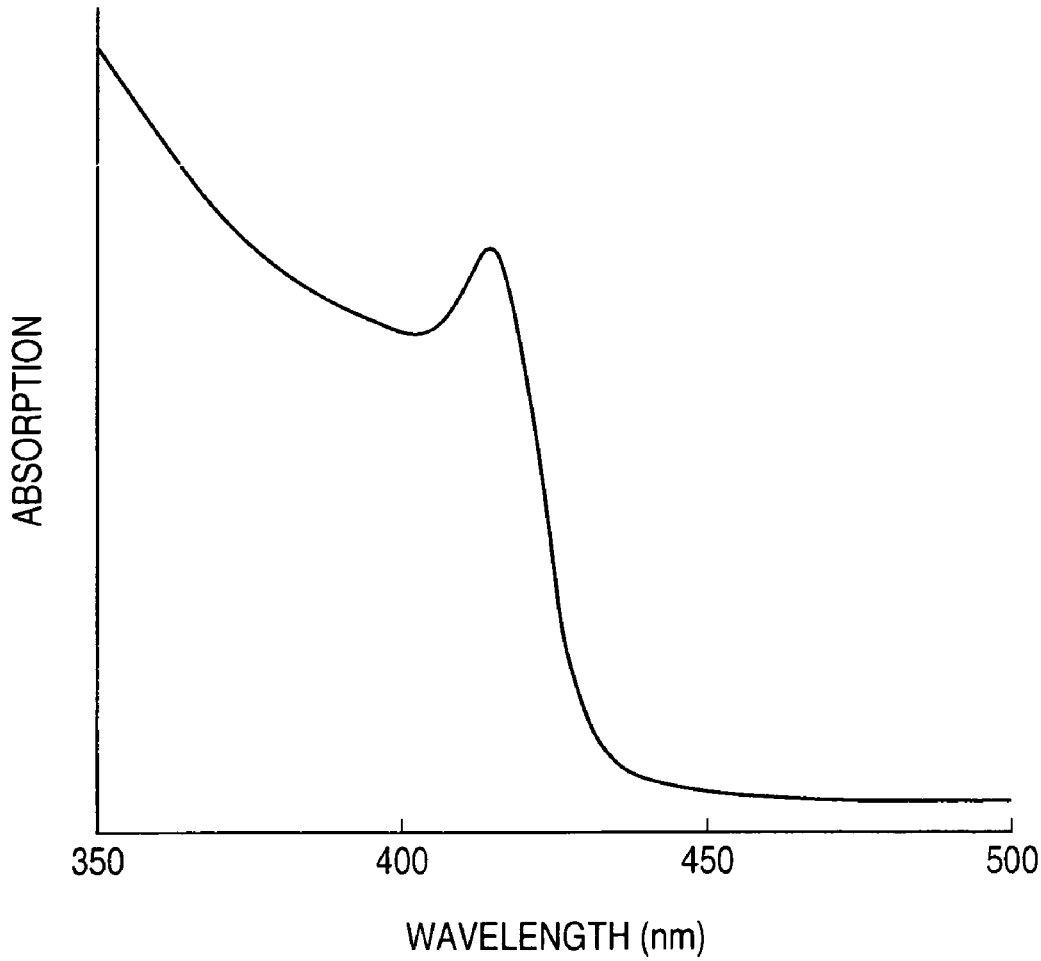

HEAT-DEVELOPABLE PHOTOSENSITIVE MATERIAL AND METHOD OF FORMING IMAGES

FIELD OF THE INVENTION

The present invention relates to a heat-developable photosensitive material and a method of forming images.

BACKGROUND OF THE INVENTION

In the medical field, reduction in wastes of processing solutions has been desired in recent years from the viewpoints of safeguarding the environment and saving space. Attainment of this desire requires new technologies regarding light-sensitive heat-developable photographic materials used for medical diagnostic purposes and photographic technology applications, which can undergo exposure with efficiency by use of a laser image setter or a laser imager and form clear black images having high resolution and high sharpness. It is possible for those light-sensitive heat-developable photographic materials to eliminate the necessity for using solutions of processing chemicals and to provide simple and environmentally friendly heat-developable processing systems for customers.

As fine depiction is essential to them, images for medical-care use are required to have high quality including high sharpness and excellent graininess, though such a requirement is also present in the field of general image-forming materials, and besides, they have a feature that it is desirable for them to have a cold black tone from a viewpoint of ease of diagnosis. At present, various kinds of hard copy systems utilizing pigments or dyes, such as inkjet printers and electrophotography, are distributed as general image-forming systems, but they are not satisfactory as output system of images for medical-care use.

On the other hand, heat image formation systems utilizing organic silver salts are described, e.g., in U.S. Pat. Nos. 3,152,904 and 3,457,075, and Thermally Processed Silver Systems by Shely in "Imaging Processes and Materials", Neblette's 8th Edition, compiled by Sturge, V. Walworth & A, Shepp, p. 2 (1996).

In particular, a heat-developable photosensitive material has a light-sensitive layer ordinarily containing a catalytic amount of photocatalyst (e.g., silver halide), a reducing agent, a reducible silver salt (e.g., an organic silver salt) and, if needed, a toning agent for controlling the tone of silver, dispersed in a binder matrix. After imagewise exposure, the heat-developable photosensitive material is heated at a high temperature (e.g., at least 80° C.) to cause a redox reaction between silver halide or a reducible silver salt (functioning as an oxidizing agent) and a reducing agent, thereby forming a black silver image. The redox reaction is accelerated by the catalytic action of a latent image formed from the silver halide by exposure. Accordingly, the black silver image is formed in the exposed area. Those heat-developable photosensitive materials are disclosed in many documents including U.S. Pat. No. 2,910,377 and JP-B-43-4924 (the term "JP-B" as used herein means an "examined Japanese patent publication"), and Fuji Medical Dry Imager FM-DP L is available as a medical-care image formation system utilizing a heat-developable photosensitive material.

A heat-image formation system utilizing an organic silver salt is produced by a method of using a solvent for coating, or a method of applying and drying a coating composition containing an aqueous dispersion of polymer particles as a main binder. The latter method eliminates a step of recovering a solvent, so it permits simplification of production facilities and has an advantage in its suitability for mass production.

Since it has no fixation step, such an image formation system utilizing an organic silver salt has a serious problem with preservation after development processing, particularly deterioration of print-out under exposure to light. With the intention of improving the print-out phenomenon, the method of utilizing AgI formed by conversion of an organic silver salt is disclosed in U.S. Pat. No. 6,143,488 and European Patent No. 0922995. However, the method of converting an organic silver salt by the use of iodide as disclosed in those references cannot provide sufficient sensitivity, so it is difficult to form a practical system.

Other photosensitive materials utilizing AgI are described, e.g., in WO 97-48014, WO 97-48015, U.S. Pat. No. 6,165,705, JP-A-8-297345 (the term "JP-A" as used herein means an "unexamined published Japanese patent application") and Japanese Patent No. 2,785,129. However, these photosensitive materials cannot achieve satisfactory sensitivity and fog level and fail to meet the practical use as photosensitive materials for laser exposure. Therefore, development of methods of successfully using silver halide having a high silver iodide content has been awaited.

On the other hand, the image formation method using blue to ultraviolet laser light and the sensitive material therefor are disclosed in JP-A-2000-305213, but Ag! is not used therein and the sensitivity thereof is insufficient.

SUMMARY OF THE INVENTION

Therefore, an object of the invention is to provide a heat-developable photosensitive material which has high sensitivity and ensures high image quality, especially excellent stability in sensitivity without affected by temperature at the time of exposure, though it is a photosensitive material using silver halide having a high silver iodide content. Another object of the invention is to provide an image formation method using such a photosensitive material.

These objects are achieved using a heat-developable photosensitive material as described below.

(1) A heat-developable photosensitive material comprising light-sensitive silver halide, a light-insensitive organic silver salt, a reducing agent and a binder on a support, wherein at least 30 mole % of the total light-sensitive silver halide is silver halide of high silver iodide content having an average γ-phase proportion of from 5 to 70 mole %.

The invention also includes the following items.

(2) A heat-developable photosensitive material as described in item (1), which further comprises a compound represented by the following formula (1) in a content of from 0.2 to 5 moles per mole of the light-sensitive silver halide on the same side as the light-sensitive silver halide on the support:

(1)

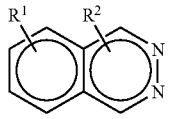

wherein $R^1$ and $R^2$ each independently represent a hydrogen atom or a group capable of substituting on the benzene ring.

(3) A heat-developable photosensitive material as described in item (1) or (2), wherein the light-sensitive silver halide is silver halide formed in the absence of a light-insensitive organic silver salt.

(4) A heat-developable photosensitive material as described in any of items (1) to (3), wherein at least 30 mole % of the total light-sensitive silver halide is silver halide of high silver iodide content having an average γ-phase proportion of from 10 to 50 mole %.

(5) A method of forming images comprising exposing the heat-developable photosensitive material as described in any of items (1) to (4) using as a light source a semiconductor laser having a peak of light-emission strength in the wavelength region of 350 to 450 nm.

(6) A method of forming images comprising exposing the heat-developable photosensitive material as described in any of items (1) to (4) using as a light source a semiconductor laser having a peak of light-emission strength in the wavelength region of 390 to 430 nm.

BRIEF DESCRIPTION OF DRAWING

FIG. 1 is a graph showing the light absorption of a silver iodide emulsion preferably used in the invention.

DETAILED DESCRIPTION OF THE INVENTION

The invention is described below in more detail.

The light-sensitive silver halide used in the invention contains at least 30 mole % of silver halide of high silver iodide content having an average γ-phase proportion of from 5 to 70 mole %. In general, silver halide of high silver iodide content is low in sensitivity and of inferior utility value.

It is preferred that a part of the present silver halide has a phase capable of absorbing light by a direct transition. It is well known that, in the present exposure wavelength region of 350 to 450 nm, the absorption by a direct transition can be effected by having a high silver iodide content composition of a hexagonal wurtzite-type structure or a cubic zinc-blend type structure. However, the silver halide having such a type absorption structure ordinarily has low sensitivity, and so it has a little utility value in the photographic industry.

As a result of our investigations, it has been also found that high sensitivity and high sharpness can be particularly achieved by incorporating the silver halide of high silver iodide content into a heat-developable photosensitive material containing a light-insensitive silver salt of organic acid and a thermal developer and exposing the heat-developable photosensitive material at high intensity illumination (at least 1 $mW/mm^2$) for a short time (exposure for 1 second or shorter, preferably $10^{-2}$ second or shorter, more preferably $10^{-4}$ second or shorter).

According to the invention, a grain size of the silver halide used is preferably 80 nm or below. Using the silver halide having such a fine grain size, the present effects are particularly distinctly achieved.

The high silver iodide content composition having the hexagonal wurtzite-type structure is designated as a γ-phase, and the high silver iodide content composition having a cubic zinc-blende type structure is designated as a β-phase. A part of the silver halide grain of high silver iodide content of the present has the γ-phase structure It has also been found that reduction insensitivity change attributed to temperature at the exposure can be attained by using the silver halide of high silver iodide content having the γ-phase structure together with a compound represented by formula (1).

The components constituting the present heat-developable photosensitive material are described below in detail.

The silver halide used in the invention has the high silver iodide content structure, and the silver halide of high silver iodide content having an average γ-phase proportion of from 5 to 70 mole % accounts for at least 30 mole % of the total silver halide.

Preferably, the silver halide of high silver iodide content having an average γ-phase proportion of from 10 to 50 mole % accounts for at least 30 mole % of the total silver halide.

More preferably, the silver halide of high silver iodide content having an average γ-phase proportion of from 25 to 50 mole % accounts for at least 30 mole % of the total silver halide.

A content of the silver halide of high silver iodide content in the total silver halide is preferably at least 50 mole %, more preferably at least 70 mole %, and still more preferably at least 90 mole %.

With increasing the content of the silver halide of high silver iodide content having an average γ-phase proportion as described above, the present effects are more clearly achieved.

The term "average γ-phase proportion" as used herein can be determined by using the methodology proposed by C. R. Berry. According to the methodology, the average γ-phase proportion is determined based on a ratio between the peak heights corresponding to (100), (101) and (002) of β-phase silver iodide and the peak height corresponding to (111) of γ-phase silver iodide by X-ray powder diffractometry, and for details thereof, e.g., *Physical Review*, volume 161, Number 3, pages 848–851 (1967) can be referred to.

It is preferable that the present silver halide shows the direct transition absorption originated in the silver iodide crystal structure at a wavelength ranging from 350 nm to 450 nm. Whether or not the silver halide has light absorption attributed to the direct transition can be easily recognized by observation of exciton absorption arising from the direct transition in the vicinity of 400–430 nm.

The light absorption of a silver iodide emulsion preferably used in the invention is shown in FIG. 1. As can be seen from FIG. 1, the absorption caused by exciton of the silver iodide can be observed in the vicinity of 420 nm.

The high silver iodide phase showing the direct transition type of light absorption may be present alone, but it is preferred that such a phase be present in a state that it junctures to silver halide showing indirect-transition absorption in the wavelength region of 350–450 nm, such as silver bromide, silver chloride, silver iodobromide, silver iodochloride and mixed crystals of these silver halides.

The silver halide phase absorbing light by the direct transition shows strong absorption of light, but it has low sensitivity, compared with the silver halide phase of indirect transition showing only weak absorption. Therefore, the former phase has not been utilized industrially.

According to the invention, satisfactory sensitivity can be achieved by exposing the silver halide photosensitive material as described above to light of wavelength ranging from 350 to 450 nm.

The wavelength at which the exposure is performed ranges preferably from 370 to 430 nm, more preferably from 390 to 430 nm, particularly preferably from 390 to 420 nm.

The present light-sensitive silver halide can show more desirable characteristics when its grain size is from 5 nm to 80 nm. Particularly, the silver halide grain having the phase showing direct transition absorption can provide the desired sensitivity by reducing its size to 80 nm or below.

The grain size of light-sensitive silver halide is preferably from 5 am to 60 nm, more preferably from 10 nm to 50 nm. The term "grain size" as used herein means a diameter of a sphere having a volume equivalent to the volume of silver halide grain.

Methods for forming the light-sensitive silver halide are well known in the field of art. For instance, the methods disclosed in "Research Disclosure", No. 17029 (June, 1978) and U.S. Pat. No. 3,700,458 can be used. More specifically, the light-sensitive silver halide is prepared by adding a silver-providing compound and a halogen-providing compound to a gelatin or other polymer solution, and then mixed with an organic silver salt. In addition, it is also preferred to use the method disclosed in JP-A-11-119374, paragraphs [0217] to [0224], and the methods disclosed in JP-A-11-352627 and JP-A-2000-347335.

Grain shape of the silver halide includes cubic, octahedral, dodecahedral, tetradecahedral, tabular, spherical, columnar and potato-like shapes. In the invention, cubic grain is particularly preferred. In addition, silver halide grain having rounded corners is also preferable.

The silver halide grain preferably used in the invention is silver halide grain on the outermost surface of which a hexacyano-metal complex is present. Examples of the hexacyano-metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, the hexacyano-iron complex is preferably used.

The hexacyano-metal complex is present in the form of an ion in an aqueous solution. So the counter cation is of little importance, but a cation miscible with water and suitable for the precipitation operation of silver halide emulsion, for example, an alkali metal ion including sodium ion, potassium ion, rubidium ion, cesium ion and lithium ion, an ammonium ion or an alkylammonium ion (e.g., tetramethylammonium ion, tetraethylammonium ion, tetrapropylammonium ion, tetra(n-butyl)ammonium ion) is preferably used.

The hexacyano-metal complex can be added by dissolving in water or a mixed solvent of water and an appropriate organic solvent miscible with water (e.g., alcohol, ether, glycol, ketone, ester and amide), or mixing with gelatin.

The amount of the hexacyano-metal complex added is preferably from $1\times10^{-5}$ mole to $1\times10^{-2}$ mole, more preferably from $1\times10^{-4}$ mole to $1\times10^{-3}$ mole, per mole of silver.

In order to make a hexacyano-metal complex be present on the outermost surface of silver halide grain, the hexacyano-metal complex is directly added after the conclusion of addition of an aqueous silver nitrate solution used for grain formation and before the conclusion of preparation process, specifically, before a chemical sensitization process, in which chalcogen sensitization, such as sulfur sensitization, selenium sensitization or tellurium sensitization, or noble metal sensitization, such as gold sensitization is carried out, or during a washing process, a dispersion process or the chemical sensitization process. For inhibiting the growth of fine silver halide grain, it is desirable to add the hexacyano-metal complex after the grain formation without delay and before the conclusion of the preparation process.

The addition of hexacyano-metal complex preferably starts after the addition of 96 weight % of the total amount of silver nitrate added for the grain formation, more preferably after the addition of 98 weight % of the total amount of silver nitrate added for the grain formation, and particularly preferably after the addition of 99 weight % of the total amount of silver nitrate added for the grain formation.

When the hexacyano-metal complex is added after the addition of an aqueous silver nitrate solution very close to the completion of grain formation, it can adsorb to the outermost surface of silver halide grain, and mostly forms lightly soluble salt together with silver ion present on the grain surface. The thus formed silver salt of hexacyano-iron (II) is less soluble than AgI, so that it can inhibit the re-dissolution attributed to fine grain and enables the production of silver halide grain having a small grain size.

The present light-sensitive silver halide grain can contain metal belonging to group VIII to group X of the periodic table (listing elements of group I to group XVIII) or a complex thereof.

The metal of group VIII to group X of the periodic table or the central metal of the metal complex includes preferably rhodium, ruthenium and iridium. The metal complexes may be used alone, or as a combination of two or more complexes of metals of the same kind or different kinds.

The Suitable content of the metal or metal complex is from $1\times10^{-9}$ to $1\times10^{-3}$ mole per mole of silver.

The heavy metal, the complex thereof and their addition methods are described in JP-A-7-225449, JP-A-11-65021, paragraphs [00189] to [0024], and JP-A-11-119374, paragraphs [0227] to [0240].

Further, metal complex which can be present in the present silver halide grain (e.g., $[Fe(CN)_6]^{-4}$), desalting methods and chemical sensitization methods of silver halide emulsion are described in JP-A-11-84574, paragraphs [0046] to [0050], JP-A-11-65021, paragraphs [0025] to [0031], and JP-A-11-119374, paragraphs [0242] to [0250].

The light-sensitive silver halide emulsion used in the invention can contain various gelatins. In order that a dispersion of a light-sensitive silver halide emulsion in a coating solution containing an organic silver salt is kept in a good condition, it is preferred to use gelatin having a low molecular weight of from 500 to 60,000. Such low-molecular-weight gelatin may be used at the time of forming grain or dispersing after the desalting step. Preferably, it is used at the time of dispersing after the desalting step.

In the invention can be used various compounds known as supersensitizers for the purpose of increasing intrinsic sensitivity. Examples of the supersensitizer usable in the invention include the compounds disclosed in EP-A-587338, U.S. Pat. Nos. 3,877,943 and 4,873,184, JP-A-5-341432, JP-A-11-109547 and JP-A-10-111543.

It is advantageous for the present light-sensitive silver halide grain to be chemically sensitized in accordance with a sulfur sensitization method, a selenium sensitization method or a tellurium sensitization method. The compounds preferably used in the sulfur, selenium and tellurium sensitization methods include known compounds, such as the compounds disclosed in JP-A-7-128768.

In the invention, tellurium sensitization is preferred in particular. For tellurium sensitization, the compounds described in the references cited in JP-A-11-65021, paragraph [0030], and the compounds represented by formulae (II), (III) and (IV) in JP-A-5-313284 are preferably used.

In the invention, chemical sensitization can be performed at any time within a period between the completion of grain formation and the start of coating, specifically after desalting, (1) before spectral sensitization, (2) simultaneously with spectral sensitization, (3) after spectral sensitization, or (4) immediately before coating. In particular, it is preferable to perform the chemical sensitization after spectral sensitization.

The amount of sulfur, selenium and tellurium sensitizers used in the invention may vary depending on the silver halide grain used and chemical ripening conditions. Specifically, it is used in the order of $10^{-8}$ to $10^{-2}$ mole, preferably $10^{-7}$ to $10^{-3}$ mole, per mole of silver halide. The invention has no particular restrictions as to conditions for chemical sensitization, but ordinarily the pH is from 5 to 8, the pAg is from 6 to 11 and the temperature is from 40 to 95° C.

To the silver halide emulsion used in the invention, a thiosulfonic acid compound may be added according to the method disclosed in EP-A-293917.

In the present photosensitive material, only one kind of light-sensitive silver halide emulsion may be used, or two or more of light-sensitive silver halide emulsions (differing in average grain size, halide composition, crystal habit or condition for chemical sensitization) maybe used in combination. The use of plural light-sensitive silver halide emulsions differing in sensitivity enables gradation control.

The techniques concerning the above are disclosed, e.g., in JP-A-57-119341, JP-A-53-106125, JP-A-47-3929, JP-A-48-55730, JP-A-46-5187, JP-A-50-73627 and JP-A-57-150841. As to the sensitivity difference, it is preferred that the sensitivities of emulsions are different from each other by at least 0.2 log E.

The amount of light-sensitive silver halide added is preferably from 0.03 to 0.6 g/m$^2$, more preferably from 0.07 to 0.4 g/m$^2$, particularly preferably from 0.05 to 0.3 g/m$^2$, expressed in the amount of silver coated per m$^2$ of photosensitive material. A ratio of light-sensitive silver halide to an organic silver salt used in combination therewith is preferably from 0.01:1 to 0.3:1 by mole, more preferably from 0.02:1 to 0.2:1 by more, still more preferably from 0.03:1 to 0.15:1 by mole.

With respect to the method and condition for mixing light-sensitive silver halide and an organic silver salt prepared separately, there are known the method of mixing the silver halide grain and the organic silver salt after the preparation by means of a high-speed stirrer, a ball mill, a sand mill, a colloid mill, a vibration mill or a homogenizer, or the method of preparing an organic silver salt wherein light-sensitive silver halide after the preparation is admixed at any timing during the preparation of organic silver salt.

As described above, it is preferable that the present silver halide is silver halide prepared in a condition free from an organic silver salt. In addition, it is preferable for control of photographic characteristics to mix two or more aqueous organic silver salt dispersions with two or more aqueous light-sensitive silver salt dispersions.

The suitable timing at which the present silver halide is added to a coating solution for an image-forming layer is from 180 minutes before to just before the start of coating, preferably from 60 minutes to 10 seconds before the start of coating. There are no restrictions on the method and condition for mixing the present silver halide with the coating solution so far as the effects of the invention can be sufficiently achieved.

Specific examples of the mixing method include a mixing method using a tank controlled so that the average stay time calculated from the rate of liquid flow added to the tank and the volume of the liquid sent into a coater becomes the desired value, and a method of using a static mixer as described in N. Harnby, M. F. Edwards & A. W. Nienow, "Ekitai Kongou Gijutsu" (translated by Koji Takahashi), chapter 8, Nikkan Kogyo Shinbun-sha (1989).

The photosensitive material may have any gradation, but it is preferable for full achievement of the present effects that the average contrast in the density range of 1.5 to 3.0 is from 1.5 to 10.

The term "average contrast" as used herein means gradient of a line connecting a point of optical density 1.5 and a point of optical density 3.0 on a characteristic curve obtained by plotting logarithm of a laser exposure amount as the abscissa and, as the ordinate, an optical density of the photosensitive material exposed in the corresponding exposure amount and subjected to heat development.

From the viewpoint of enhancing a clear cut property of letter images, the average contrast is preferably from 1.5 to 10, more preferably from 2.0 to 7, still more preferably from 2.5 to 6.

Now, a toning agent usable in the present heat-developable photosensitive material is described.

The toning agents are described in JP-A-10-62899, paragraphs [0054] and [0055], EP-A-803764, page 21, lines 23 to 48, JP-A-2000-356317 and JP-A-2000-187298 give descriptions of toning agents. Specifically, phthalazinones (e.g., phthalazinone, phthalazinone derivatives or metal salts thereof, such as 4-(1-naphthyl)phthalazinone, 6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, tetrachlorophthalic anhydride); phthalazines (e.g., phthalazine, phthalazine derivatives or metal salts thereof, such as 4-(1-naphthyl)phthalazine, 6-isopropylphthalazine, 6-tert-butylphthalazine, 6-chlorophthalazine, 5,7-dimethoxyphthalazine, 2,3-dihydrophthalazine); and combinations of phthalazines and phthalic acids are preferably used. In particular, the combinations of phthalazines and phthalic acids are preferable.

The compound represented by formula (1) described hereinbefore is preferable as the toning agent used in the invention.

In formula (1), $R^1$ and $R^2$ each independently represent a hydrogen atom or a group capable of substituting on the benzene ring.

Examples of a group as $R^1$ or $R^2$, which can be substituted on the benzene ring, include an alkyl group, an aryl group, a halogen atom, a hydroxyl group and an alkoxy group. Specifically, such substituents include a methyl group, an ethyl group, a propyl group, an isopropyl group, an isobutyl group, a tert-butyl group, a chlorine atom, a methoxy group and a hydroxyl group.

Examples of the compound represented by formula (1) include 6-isopropylphthalazine, G-tert-butylphthalazine, 5-chlorophthalazine, 5,7-dimethoxyphthalazine and 2,3-dihydrophthalazine. In particular, 6-isopropylphthalazine is preferred.

The amount of toning agent added is preferably from 0.2 to 5 moles, more preferably from 0.5 to 5 moles, still more preferably from 1 to 5 moles, per mole of light-sensitive silver halide.

The toning agent is preferably used in combination with a phthalic acid. Especially advantageous combination is the combination of 6-isopropylphthalazine with phthalic acid or 4-methylphthalic acid. By combining the toning agent added in the amount as described above with γ-phase containing high silver iodide content silver halide grains, stability of sensitivity irrespective of temperature at the time of exposure can be achieved.

Although the organic silver salt usable in the invention is relatively stable to light, it can form silver image when heated at a temperature of 80° C. or higher in the presence of an exposed photocatalyst (e.g., latent image of light-sensitive silver halide) and a reducing agent. The organic silver salt may be any organic substance as far as it contains a source capable of reducing silver ion.

There are descriptions of such light-insensitive organic silver salts in JP-A-10-62899, paragraphs [0048] and [0049], EP-A-0803764, from page 18, line 24, to page 19, line 37, EP-A-0962812, JP-A-11-349591, JP-A-2000-7683 and JP-A-2000-72711.

The silver salt of organic acid, especially the silver salt of long-chain aliphatic carboxylic acid (containing 10 to 30, preferably 15 to 28, carbon atoms), is preferably used. Preferred examples of the silver salt of a fatty acid include silver behenate, silver arachidate, silver stearate, silver oleate, silver laurate, silver caproate, silver myristate, silver palmitate and mixtures of these silver salts.

Of the silver salts of these fatty acids, those having a silver behenate content ratio of preferably at least 50 mole %, more preferably at least 80 mole %, and still more preferably at least 90 mole %, are used.

The organic silver salt usable in the invention has no particular restriction on its crystal shape, and the crystal thereof may be in a needle, column, tabular or scale shape.

The organic silver salt in the crystalline shape of a scale is preferably used in the invention. In addition, organic silver salt grain in the shape of a short needle having an ratio of the major axis to the minor axis of at most 5, a rectangular solid or a cube, or in an irregular shape like a potato is also preferably used. These organic silver salt grains are notable for reduced fogging at the time of heat development, compared with long acicular grains having the ratio of the major axis to the minor axis of greater than 5.

The term "organic silver salt in the crystalline shape of a scale" as used in the invention is defined as follows. The silver salt of an organic acid is observed under an electron microscope. The crystalline shape of the silver salt of an organic acid is approximated at a rectangular solid, and the edge lengths of the rectangular solid are taken as a, b and c in the increasing order (wherein c and b may be the same). By calculation using shorter lengths a and b, x defined as "b/a ratio" is determined.

In this way, x values of about 200 grains are determined. When these grains satisfy a relation of x(average)≧1.5, wherein x(average) means the average of the x values determined, they are referred to as grains in a scale shape. Further, the grains satisfying the relation of 30≧x(average)≧1.5 are preferred, and those satisfying the relation of 20≧x(average)≧2.0 are more preferred. The acicular grains are defined as grains satisfying the inequality formula 1.5≧x(average)>1.

The a in the scale-shape grain can be regarded as thickness of tabular grain which has a surface with edge lengths of b and c as the principal plane. The average of the a value is preferably from 0.01 μm to 0.23 μm, more preferably from 0.10 μm to 0.20 μm. The average of the c/b ratio is preferably from 1 to 6, more preferably from 1.05 to 4, still more preferably from 1.1 to 3, particularly preferably from 1.1 to 2.

It is preferred that grain size distribution of the organic silver salt is monodisperse. The monodisperse means that each of the values obtained by dividing standard deviations of the lengths of the minor axis and the major axis respectively by the averages for lengths of the minor axis and the major axes respectively is, on a percentage basis, preferably 100% or below, more preferably 80% or below, still more preferably 50% or below. The crystalline shapes of organic silver salt can be determined by use of transmission electron microscope photographs of an organic silver salt dispersion.

As another method for determining the monodispersity, there is a method of finding a standard deviation of the volume weighted average diameter of organic silver salt grain. The value obtained by dividing the standard deviation by the volume weighted average diameter (variation coefficient) is, on a percentage basis, preferably 100% or below, more preferably 80% or below, still more preferably 50% or below.

The variation coefficient can be calculated, e.g., from the grain size value (volume weighted average diameter) obtained by irradiating an organic silver salt dispersed in a liquid with laser light and determining the autocorrelation function of change in fluctuations of light scattered from the salt with respect to time.

In producing and dispersing the organic silver salt used in the invention, known methods can be employed. Specifically, JP-A-10-62899, EP-A-0803763, EP-A-0962812, JP-A-11-349591, JP-A-2000-7683, JP-A-2000-72711, JP-A-2001-163889, JP-A-2001-163890, JP-A-2001-163827, JP-A-2001-33907, JP-A-2001-188313, JP-A-2001-83652, JP-A-2002-6442, JP-A-2002-31870 and JP-A-2002-107868 can be referred to.

The presence of light-sensitive silver salt at the time of dispersing the organic silver salt results in increase in fog and severe reduction in sensitivity. Therefore, it is preferable that the dispersion is carried out in the substantial absence of light-sensitive silver salt.

In the invention, the aqueous dispersion contains preferably at most 1 mole %, more preferably at most 0.1 mole %, of light-sensitive silver salt per mole of the silver salt of organic acid dispersed therein. Still more preferably, the light-sensitive silver salt is not added positively to the aqueous dispersion.

In the invention, it is possible to prepare a photosensitive material through mixing of an aqueous dispersion of organic silver salt with an aqueous dispersion of light-sensitive silver salt, and the mixing ratio of organic silver salt to light-sensitive silver salt can be chosen according to the desired purpose. The proportion of light-sensitive silver salt to organic silver salt is preferably from 1 to 30 mole %, more preferably from 2 to 20 mole %, particularly preferably from 3 to 15 mole %.

A method of mixing two or more varieties of aqueous organic silver salt dispersions with two or more varieties of aqueous light-sensitive silver salt dispersions is preferably used for adjustment of photographic characteristics.

The present organic silver salt can be used in a desired amount. Specifically, the amount of the organic silver salt used is preferably from 0.1 to 5 g/m$^2$, more preferably from 0.3 to 3 g/m$^2$, still more preferably from 0.5 to 2 g/m$^2$, on a silver basis.

It is appropriate for the present heat-developable photosensitive material to contain a thermal developer, which is a reducing agent for the organic silver salt. The reducing agent for organic silver salt may be any of substances (preferably any organic substances) capable of reducing silver ion to metallic silver.

Examples of such a reducing agent are described in JP-A-11-65021, paragraphs [0043] to [0045], and EP-A-0803764, from page 7, line 34 to page 19, line 12.

As the reducing agent used in the invention, reducing agents of so-called hindered phenol type having a substituent on the o-position of the phenolic hydroxyl group and reducing agents of bisphenol type are preferred. Of the reducing agents, compounds represented by the following formula (R) are more preferably used:

(R)

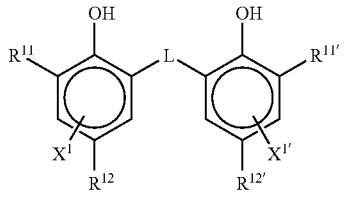

In formula (R), $R^{11}$ and $R^{11'}$ each independently represent an alkyl group containing 1 to 20 carbon atoms. $R^{12}$ and $R^{12'}$ each independently represent a hydrogen atom or a substituent capable of substituting on the benzene ring. L represents —S— or —$CHR^{13}$—. $R^{13}$ represents a hydrogen atom or an alkyl group containing 1 to 20 carbon atoms. $X^1$ and $X^{1'}$ each independently represent a hydrogen atom or a substituent capable of substituting on the benzene ring.

The formula (R) is described in more detail.

$R^{11}$ and $R^{11'}$ each independently represent a substituted or unsubstituted alkyl group containing 1 to 20 carbon atoms. The alkyl group has no particular restriction on its substituent, and preferred substituents therefor include an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group, an ureido group, an urethane group and a halogen atom. $R^{12}$ and $R^{12'}$ each independently represent a hydrogen atom or a substituent capable of substituting on the benzene ring. $X^1$ and $X^{1'}$ also each independently represent a hydrogen atom or a substituent capable of substituting on the benzene ring. Suitable examples of the substituent capable of substituting on the benzene ring include an alkyl group, an aryl group, an alkoxy group and an acylamino group.

L represents —S— or —$CHR^{13}$—. $R^{13}$ represents a hydrogen atom or an alkyl group containing 1 to 20 carbon atoms, which may have a substituent. Examples of the unsubstituted alkyl group represented by $R^{13}$ include methyl, ethyl, propyl, butyl, heptyl, undecyl, isopropyl, 1-ethylpentyl and 2,4,4-trimethylpentyl groups. Examples of the substituent for the alkyl group include the same substituents as described for the alkyl group represented by $R^{11}$.

As $R^{11}$ and $R^{11'}$ each, a secondary or tertiary alkyl group containing 3 to 15 carbon atoms is preferred. Examples of such an alkyl group include an isopropyl group, an isobutyl group, a tert-butyl group, a tert-amyl group, a tert-octyl group, a cyclohexyl group, a cyclopentyl group, a 1-methylcyclohexyl group and a 1-methylcyclopropyl group.

The group more preferable as $R^{11}$ and $R^{11'}$ each is a tertiary alkyl group containing 4 to 12 carbon atoms. Of the groups, tert-butyl, tert-amyl and 1-methylcyclohexyl groups are still more preferred. Particularly, a tert-butyl group is preferred.

As $R^{12}$ and $R^{12'}$ each, an alkyl group containing 1 to 20 carbon atoms is preferred. Examples of such an alkyl group include a methyl group, an ethyl group, a propyl group, a butyl group, an isopropyl group, a tert-butyl group, a t-amyl group, a cyclohexyl group, a 1-methylcyclohexyl group, a benzyl group, a methoxymethyl group and an ethoxyethyl group. Of the groups, methyl, ethyl, propyl, isopropyl and tert-butyl groups are more preferred.

As $X^1$ and $X^{1'}$ each, a hydrogen atom, a halogen atom and alkyl group are preferred, and a hydrogen atom is more preferred.

L is preferably —$CHR^{13}$—.

$R^{13}$ is preferably a hydrogen atom or an alkyl group containing 1 to 15 carbon atoms. Preferred examples of such an alkyl group include a methyl group, an ethyl group, a propyl group, an isopropyl group and a 2,4,4-trimethylpentyl group. A hydrogen atom, a methyl group, an ethyl group, a propyl group and an isopropyl group are particularly preferred.

When $R^{13}$ is a hydrogen atom, $R^{12}$ and $R^{12}$ each represent preferably an alkyl group containing 2 to 5 carbon atoms, more preferably an ethyl group or a propyl group, particularly preferably an ethyl group.

When $R^{13}$ is a primary or secondary alkyl group containing 1 to 8 carbon atoms, $R^{12}$ and $R^{12'}$ each preferably represent a methyl group. As the primary or secondary alkyl group containing 1 to 8 carbon atoms for $R^{13}$, a methyl group, an ethyl group, a propyl group and an isopropyl group are more preferred. In particular, methyl, ethyl and propyl groups are preferred.

When $R^{11}$, $R^{1'}$, $R^{12}$ and $R^{12'}$ all are methyl groups, it is preferred that $R^{13}$ is a secondary alkyl group. In this case, an isopropyl group, an isobutyl group or a 1-ethylpentyl group is preferred as the secondary alkyl group of $R^{13}$ of the groups, an isopropyl group is more preferred.

The heat developability and the tone of developed silver vary depending on the combination of $R^{11}$, $R^{11'}$, $R^{12}$, $R^{12'}$ and $R^{13}$ in the reducing agent described above. These characteristics can be adjusted by combined use of two or more reducing agents. Depending on the intended purpose, therefore, it is preferred to use two or more reducing agents in combination.

Examples of the compound represented by formula (R) and other reducing agents usable in the invention are illustrated below. However, these examples should not be construed as limiting the scope of the invention.

(I-1)

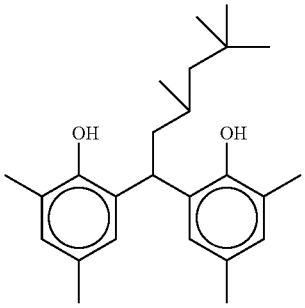

(I-2)

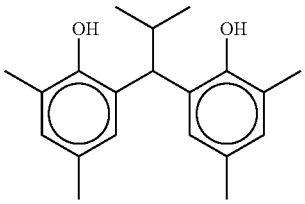

-continued
(I-3)
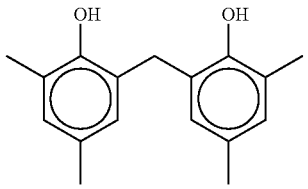
(I-4)
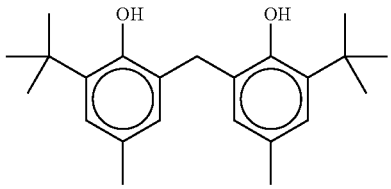
(I-5)
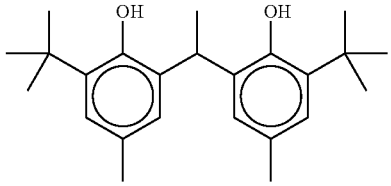
(I-6)
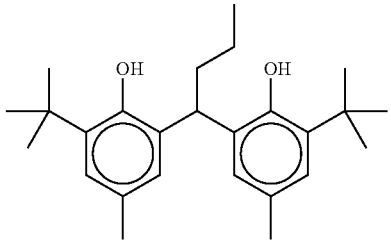
(I-7)
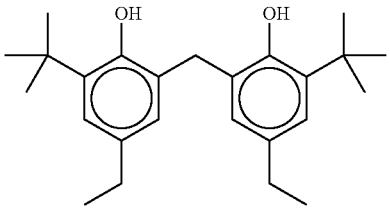
(I-8)
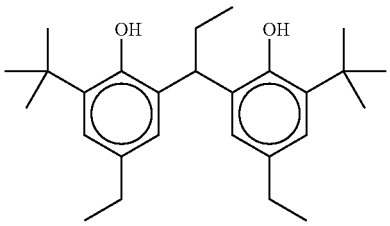
(I-9)
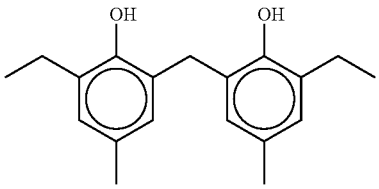
-continued
(I-10)
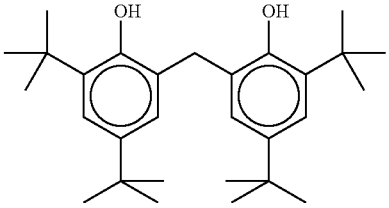
(I-11)
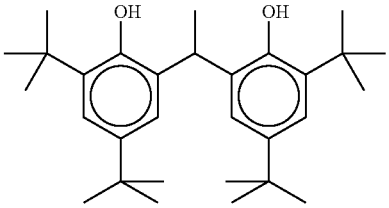
(I-12)
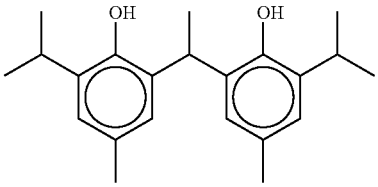
(I-13)
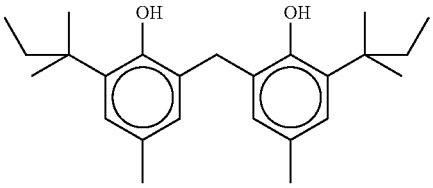
(I-14)
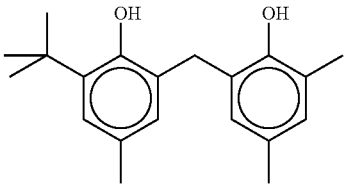
(I-15)
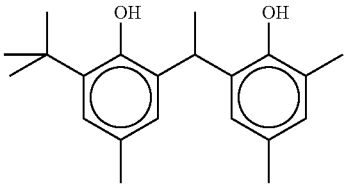
(I-16)
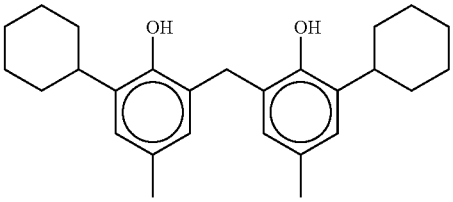

-continued
(I-17)
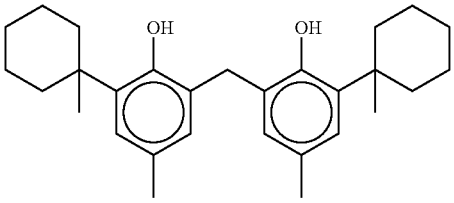
(I-18)
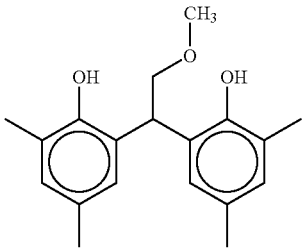
(I-19)
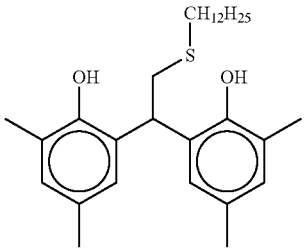
(I-20)
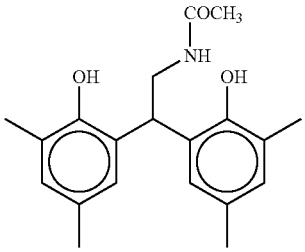
(I-21)
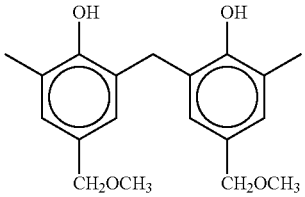
(I-22)
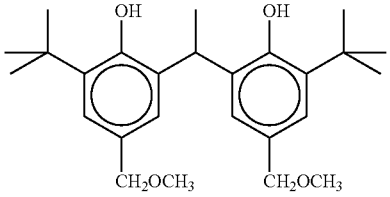
-continued
(I-23)
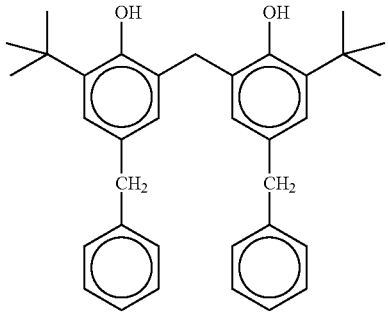
(I-24)
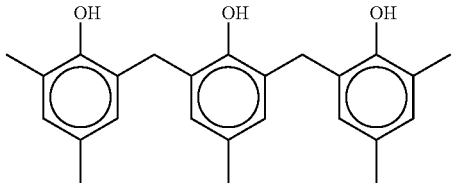
(I-25)
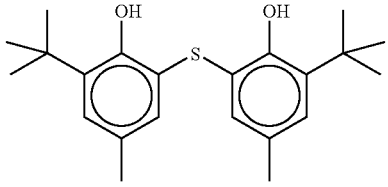
(I-26)
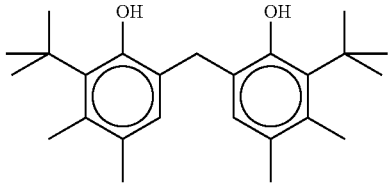
(I-27)
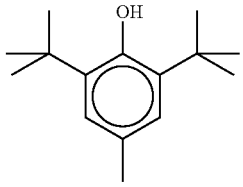
(I-28)
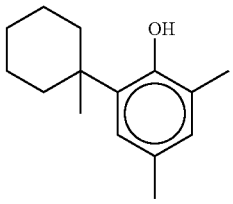
(I-29)
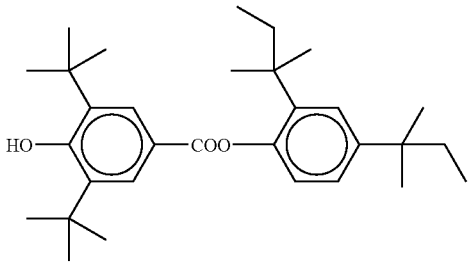

-continued (I-30)

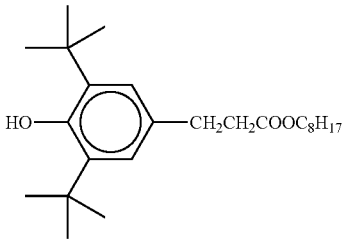

(I-31)

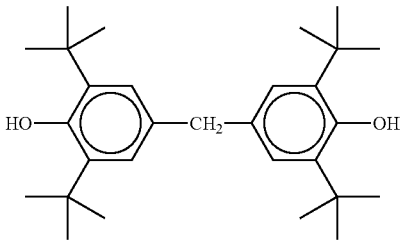

(I-32)

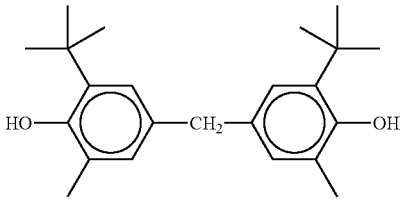

(I-33)

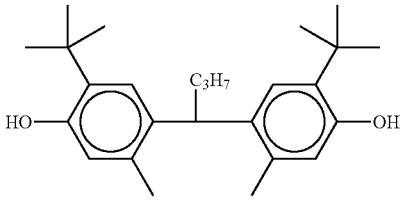

(I-34)

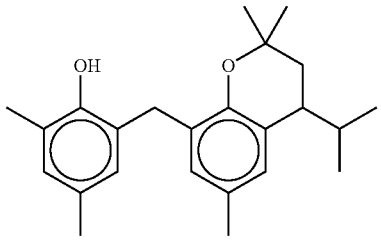

The amount of reducing agent added in the invention is preferably from 0.1 to 3.0 g/m$^2$, more preferably from 0.2 to 1.5 g/m$^2$, still more preferably from 0.3 to 1.0 g/M$^2$.

The amount of reducing agent for every one mole of silver on the side having the image-forming layer is preferably from 5 to 50 mole %, more preferably from 8 to 30 mole %, still more preferably from 10 to 20 mole %. It is preferred for the reducing agent is incorporated in the image-forming layer.

The reducing agent may be admixed in a coating solution in any form, such as solution, emulsified dispersion and fine particulate solid dispersion, and incorporated in the present photosensitive material.

In a well-known emulsified dispersion method, the reducing agent is dissolved using oil, such as dibutyl phthalate, tricresyl phosphate, glyceryl triacetate or diethyl phthalate, and an auxiliary solvent, such as ethylacetate or cyclohexanone, and mechanically made into an emulsified dispersion.

In a fine particulate solid dispersing method, on the other hand, the reducing agent powder is dispersed in an appropriate solvent, such as water, by means of a ball mill, a colloid mill, a vibrating ball mill, a sand mill, a jet mill, a roller mill or ultrasonic wave, thereby preparing a solid dispersion. The dispersion may be performed in the presence of a protective colloid (e.g., polyvinyl alcohol) or a surfactant (e.g., an anionic surfactant, such as sodium triisopropylnaphthalenesulfonate, which is a mixture of those differing in substitution positions of three isopropyl groups). In the mills recited above, zirconia beads are ordinarily used as dispersion media. In some cases, therefore, the dispersion is contaminated with zirconium eluted from the beads. The zirconium content in the dispersion is ordinarily within the range of 1 to 1,000 ppm, though it depends on dispersing conditions. As far as the zirconium content in the photosensitive material is not higher than 0.5 mg per gram of silver, zirconium produces no adverse effect in a practical sense.

In an aqueous dispersion, it is preferred to incorporate an antiseptic (e.g., sodium benzoisothiazolinone).

Compounds preferably used as development accelerator in the present heat-developable photosensitive material include the sulfonamidophenol compounds represented by formula (A) disclosed in JP-A-2000-267222 and JP-A-2000-330234, the hindered phenol compounds represented by formula (II) disclosed in JP-A-2001-92075, the hydrazine compounds represented by formula (I) disclosed in JP-A-10-62895 and JP-A-11-15116 and formula (1) disclosed in JP-A-2002-278017, and the phenol or naphthol compounds represented by formula (2) disclosed in JP-A-2001-264929.

The development accelerator is used in a proportion of 0.1 to 20 mole %, preferably from 0.5 to 10 mole %, more preferably from 1 to 5 mole %, based on the reducing agents used. It can be introduced into the photosensitive material in accordance with the same method as used for the reducing agent. In particular, it is preferable to add it as a solid dispersion or an emulsified dispersion.

In the case of adding the development accelerators as the emulsified dispersion, it is appropriate to prepare an emulsified dispersion by dispersing the development accelerator using both a high boiling solvent, which is a solid at room temperature, and an auxiliary solvent with a low boiling point, or to prepare a so-called oil-less emulsified dispersion by dispersing it without using the high boiling solvent.

Now, the hydrogen bond-forming compound usable in the invention is described below.

When the reducing agent used in the invention has an aromatic hydroxyl group (—OH), especially in the cases of a bisphenol as described above, a non-reducing compound having a group capable of forming a hydrogen bond with the hydroxyl group is preferably used in combination.

Examples of a group forming a hydrogen bond together with a hydroxyl group or an amino group include a phosphoryl group, a sulfoxido group, a sulfonyl group, a carbonyl group, an amido group, an ester group, an urethane group, an ureido group, a tertiary amino group and a nitrogen-containing aromatic group.

Of such compounds, those respectively having a phosphoryl group, a sulfoxido group, an amido group (not having >N—H moiety but being blocked in the form of>N—Ra, wherein Ra is a substituent other than H), an urethane group (not having>N—H moiety but being blocked in the form of>N—Ra, wherein Ra is a substituent other than H) and an ureido group (not having>N—H moiety but being blocked in the form of>N—Ra, wherein Ra is a substituent other than H) are preferred.

The hydrogen bond-forming compound particularly preferably used in the invention is a compound represented by the following formula (D):

(D)

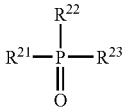

In formula (D), $R^{21}$ to $R^{23}$ each independently represent an alkyl group, an aryl group, an alkoxy group, an aryloxy group, an amino group or a heterocyclic group, each of which may be unsubstituted or may have a substituent.

Examples of the substituent for the group represented by $R^{21}$ to $R^{23}$ include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. Of the groups, alkyl and aryl groups, such as methyl, ethyl, isopropyl, tert-butyl, tert-octyl, phenyl, 4-alkoxyphenyl and 4-acyloxyphenyl groups, are preferred as the substituent.

Examples of the alkyl group for $R^{21}$ to $R^{23}$ include a methyl group, an ethyl group, a butyl group, an octyl group, a dodecyl group, an isopropyl group, a tert-butyl group, a tert-amyl group, a tert-octyl group, a cyclohexyl group, 1-methylcyclohexyl group, a benzyl group, a phenetyl group and a 2-phenoxypropyl group.

Examples of the aryl group for $R^{21}$ to $R^{23}$ include a phenyl group, a cresyl group, a xylyl group, a naphthyl group, a 4-t-butylphenyl group, a 4-tert-octylphenyl group, a 4-anisidyl group and a 3,5-dichlorophenyl group.

Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Examples of the aryloxy group include a phenoxy group, a cresyloxy group, an isopropylphenoxy group, a 4-tert-butylphenoxy group, a naphthoxy group and a biphenyloxy group.

Examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

As $R^{21}$ to $R^{23}$ each, an alkyl group, an aryl group, an alkoxy group or an aryloxy group is preferred. From the viewpoint of effects achieved by the invention, it is preferable that at least one of $R^{21}$, $R^{22}$ and $R^{23}$ is an alkyl or aryl group, and it is more preferable that at least two of $R^{21}$, $R^{22}$ and $R^{23}$ are each an alkyl or aryl group. From the viewpoint of availability of low-price compound, it is preferred that $R^{21}$, $R^{22}$ and $R^{23}$ are the same groups.

Examples of the compound represented by formula (D) and other hydrogen bond-forming compounds usable in the invention are illustrated below. However, these examples should not be construed as limiting the scope of the invention in any way.

(II-1)

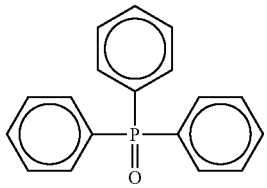

(II-2)

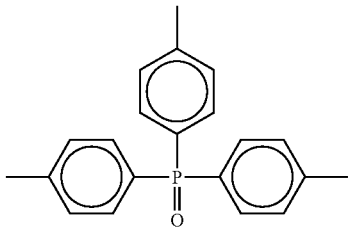

(II-3)

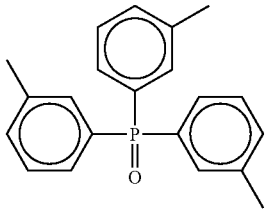

(II-4)

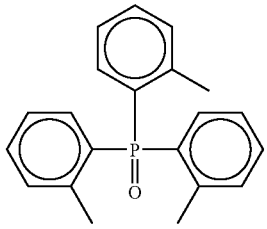

(II-5)

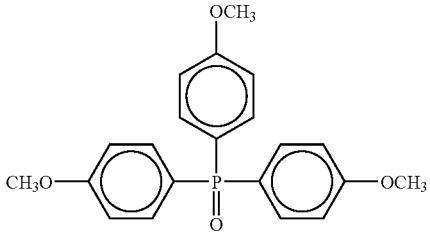

(II-6)

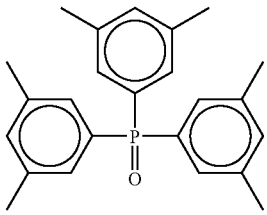

(II-7)

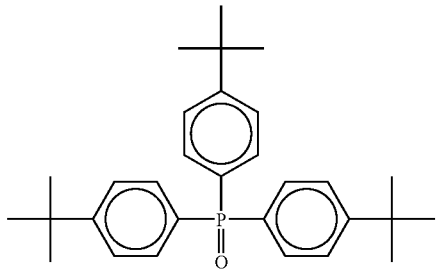

-continued (II-8)

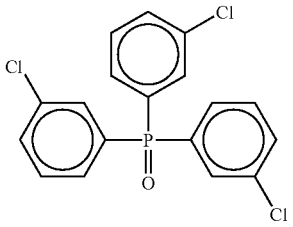

(II-9)

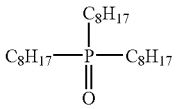

(II-10)

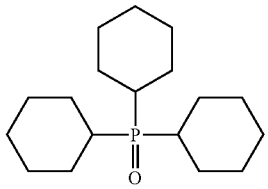

(II-11)

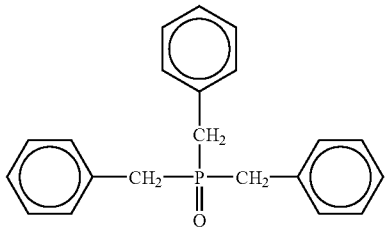

(II-12)

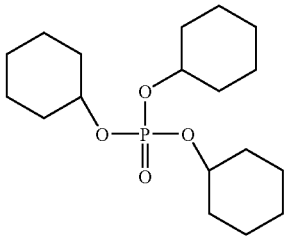

(II-13)

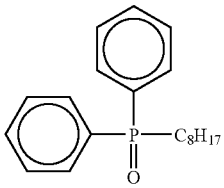

(II-14)

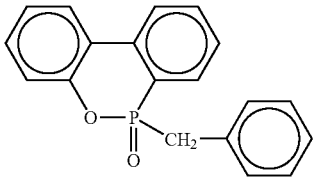

(II-15)

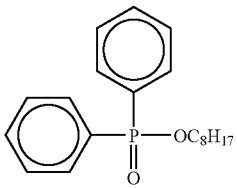

-continued (II-16)

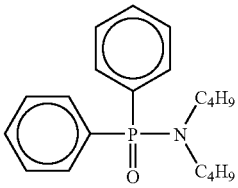

(II-17)

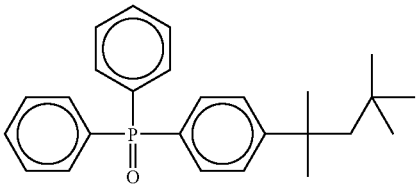

(II-18)

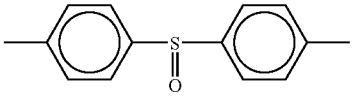

(II-19)

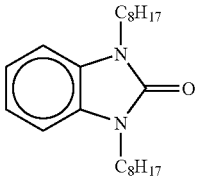

(II-20)

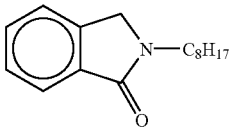

(II-21)

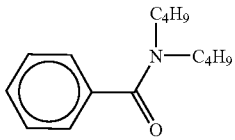

In addition to the compounds recited above, examples of the hydrogen bond-forming compound include those disclosed in European Patent No. 1096310, JP-A-2002-156727 and JP-A-2002-318431.

The compound represented by formula (D) in the invention, similar to the case of the reducing agent, can be added to a coating solution in the form of a solution, an emulsified dispersion or a fine particulate solid dispersion, and incorporated in a photosensitive material. When the compound is in a solution state, the compound forms a complex involving hydrogen bond with a compound containing a phenolic hydroxyl group or an amino group. Depending on the combination of the reducing agent and the compound represented by formula (D) in the invention, the complex can be isolated in a crystalline state. Using the isolated crystalline powder as a fine particulate solid dispersion is preferred in particular from the viewpoint of ensuring stable performances. It is also preferred to adopt a method in which the reducing agent in a powdery state and the compound of formula (D) in a powdery state are mixed and the resultant mixture is dispersed using an appropriate dispersant by a device such as a sand grinder mill (SGM), thereby forming the complex thereof.

The compound represented by formula (D) is preferably used in a proportion of from 1 to 200 mole %, more preferably from 10 to 150 mole %, still more preferably from 20 to 100 mole %, based on the reducing agent.

Now, the binder usable in the invention is described below.

As the binder for the present organic silver salt-containing layer, any polymer may be used. Examples of the binder used preferably include transparent or translucent, ordinarily colorless, natural resins, synthetic resins, polymers and copolymers, and other film-forming media, such as gelatin, rubber, polyvinyl alcohol, hydroxyethyl cellulose, cellulose acetate, cellulose acetate butyrate, polyvinyl pyrrolidone, casein, starch, polyacrylic acid, polymethyl methacrylate, polyvinyl chloride, polymethacrylic acid, styrene-maleic anhydride copolymer, styrene-acrylonitrile copolymer, styrene-butadiene copolymer, polyvinyl acetal (such as polyvinyl formal or polyvinyl butyral), polyester, polyurethane, phenoxy resin, polyvinylidene chloride, polyepoxide, polycarbonate, polyvinyl acetate, polyolefin, cellulose ester and polyamide.

The binder may form a coating film through the use of water, an organic solvent or an emulsion.

The glass transition temperature of binder used in the organic silver salt-containing layer is preferably from 0° C. to 80° C. (hereinafter, the binder having its glass transition temperature in such a temperature range is also referred to as a high Tg binder sometimes), more preferably from 10° C. to 70° C., still more preferably from 15° C. to 60° C.

The Tg is calculated according to the following equation in the specification:

$$1/Tg=\Sigma(Xi/Tgi)$$

wherein, assuming that the polymer is a copolymer composed of n monomers from i=1 to i=n, Xi is a weight fraction of the ith monomer ($\Sigma Xi=1$) and Tgi is glass transition temperature (measured in kelvin) of a homopolymer formed from the ith monomer. The symbol $\Sigma$ means the sum of i=1 to i=n.

The value of the glass transition temperature of a homopolymer formed from each monomer (Tgi) is adopted from J. Brandrup & E. H. Immergut, *Polymer Handbook*, 3rd. Edition, Wiley-Interscience (1989).

Two or more binders maybe used in combination, if needed. In addition, a binder having a glass transition temperature of 20° C. or higher and a binder having a glass transition temperature lower than 20° C. may be used in combination. When two or more polymers differing in Tg are used in combination, it is preferred that a weight average Tg is within the foregoing range.

In the invention, it is preferable that the organic silver salt-containing layer is formed by applying a coating solution wherein water constitutes at least 30 weight % of its solvent and drying to form a film.

In the invention, enhanced performances can be achieved when the organic silver salt-containing layer is formed by applying and drying a coating solution containing water in a proportion of at least 30 weight % based on the total amount of solvent used, further when the binder used in the organic silver salt-containing layer can be dissolved or dispersed in a water-based solvent (aqueous solvent), and particularly when a binder comprising a latex of polymer having an equilibrium moisture content of 2 weight % or below under conditions of 25° C. and 60% RH. According to the most preferable form, the organic silver salt-containing layer is prepared so as to have an ionic conductivity of 2.5 mS/cm or below. The preparation method thereof includes purifying a synthesized polymer by use of an isolation membrane.

The term "water-based solvent", in which a binder can be dissolved or dispersed, is intended to include water and a mixture of water and at most 70 weight % of a water-miscible organic solvent.

Examples of the water-miscible organic solvent include alcohol solvents, such as methyl alcohol, ethyl alcohol or propyl alcohol, cellosolve solvents, such as methyl cellosolve, ethyl cellosolve or butyl cellosolve, ethyl acetate and dimethylformamide.

The term "water-based solvent" is also used for a solvent in which the polymer is not dissolved thermodynamically but present in a so-called dispersed state.

The equilibrium moisture content (in weight %) under conditions of 25° C. and 60% RH can be described by the following equation using the weight of a polymer in a moisturized equilibrium under the 25° C.–60% RH atmosphere, W1, and the weight of the polymer in an absolutely dried state at 25° C., W0:

$$\text{Equilibrium moisture content under 25° C. and 60\% RH}=\{(W1-W0)/W0\}\times 100$$

Regarding the definition of the moisture content and the method for measuring thereof, e.g., "Kobunshi Zairyo Shikenho", the 14th volume of Koubunshi Kougaku Kouza, compiled by Koubunshi Gakkai, published by Chijinshokan can be referred to.

The equilibrium moisture content of the binder polymer under conditions of 25° C. and 60% RH is preferably 2 weight % or below, more preferably from 0.01 to 1.5 weight %, still more preferably from 0.02 to 1 weight %.

In the invention, a polymer dispersible in a water-based solvent is preferable in particular. Examples of the polymer in a dispersed state include latex in which fine particles of a water-insoluble, hydrophobic polymer are dispersed, and a dispersion in which a polymer molecule is dispersed in a molecular state or in the form of micelle. Particles dispersed in a latex form are preferable.

The average diameter of dispersed particles is from 1 to 50,000 nm, preferably from 5 to 1,000 nm, more preferably from 10 to 500 nm, still more preferably from 50 to 200 nm. The diameter distribution of dispersed particles is not particularly restricted, and both broad particle diameter distribution and monodisperse particle diameter distribution may be used. A mixture of two or more polymers each having monodisperse particle diameter distribution is also advantageous from the viewpoint of controlling physical properties of the coating solution.

Preferred examples of the polymer dispersible in a water-based solvent include hydrophobic polymer, for example, acrylic polymer, polyester, rubber (e.g., SBR resin), polyurethane, polyvinyl chloride, polyvinyl acetate, polyvinylidene chloride and polyolefin. The polymer may be a linear, branched or cross-linked polymer, and it may be a polymer obtained by polymerization of single-sort monomer, namely a so-called homopolymer, or a copolymer obtained by polymerization of two or more sorts of monomers. In the case of copolymer, both random and block copolymers are usable.

The number average molecular weight of the polymer is preferably from 5,000 to 1,000,000, more preferably from 10,000 to 200,000. When the molecular weight is too low, the mechanical strength of the emulsion layer becomes insufficient, while too high molecular weight is undesirable because of poor film formability. In particular, cross-linking polymer latex is preferably used.

Preferred examples of the polymer latex are recited below, but the invention should not be construed as being limited to these examples.

In the following examples, each latex is represented by monomer as starting material, each figure in parentheses is expressed in weight %, and each molecular weight is number average molecular weight. When polyfunctional monomer is used, the concept of molecular weight cannot be applied because a cross-linked structure is formed. Therefore, such a latex is described as cross-linking and its molecular weight description is omitted. Tg stands for a glass transition temperature.

P-1; -MMA(70) -EA(27)-MAA(3)-latex (molecular weight: 37,000, Tg: 61° C.)

P-2; -MMA(70)-2EHA(20)-St(5)-AA(5)-latex (molecular weight: 40,000, Tg: 59° C.)

P-3; -St(50)-Bu(47)-MAA(3)-latex (cross-linking, Tg: −17° C.)

P-4; -St(68)-Bu(29)-AA(3)-latex (cross-linking, Tg: 17° C.)

P-5; -St(71)-Bu(26)-AA(3)-latex (cross-linking, Tg: 24° C.)

P-6; -St(70)-Bu(27)—IA(3)-latex (cross-linking)

P-7; -St(75)-Bu(24)-AA(1)-latex (cross-linking, Tg: 29° C.)

P-8; -St(60)-Bu(35)-DVB(3)-MAA(2) latex (cross-linking)

P-9; -St(70)-Bu(25)-DVB(2)-AA(3)-latex (cross-linking)

P-10; -VC(50)-MMA(20)-EA(20)-AN(5)-AA(5)-latex (molecular weight: 80,000)

P-11; -VDC(85)-MMA(5)-EA (5)-MAA (5)-latex (molecular weight: 67,000)

P-12; -Et(90)-MAA(10)-latex (molecular weight: 12,000)

P-13; -St(70)-2EHA(27)-AA(3)-latex (molecular weight: 130,000, Tg: 43° C.)

P-14; -MMA(63)-EA(35)-AA(2)-latex (molecular weight: 33,000, Tg: 47° C.)

P-15; -St(70.5)-Bu(26.5)-AA(3)-latex (cross-linking, Tg: 23° C.)

P-16; -St(69.5)-Bu(27.5)-AA(3)-latex (cross-linking, Tg: 20.5° C.)

The abbreviations in the above formulae stand for the following monomers respectively: MMA; methyl methacrylate, EA; ethyl acrylate, MAA; methacrylic acid, 2EHA; 2-ethylhexyl acrylate, St; styrene, Bu; butadiene, AA; acrylic acid, DVB; divinylbenzene, VC; vinyl chloride, AN; acrylonitrile, VDC; vinylidene chloride, Et; ethylene, IA; itaconic acid.

The polymer latices recited above are also commercially available, and the following products can be used. Examples of acrylic polymer products include Sebian A-4635, 4718 and 4601 (produced by DAICEL CHEMICAL INDUSTRIES, LTD), and Nipol Lx811, 814, 821, 820 and 857 (produced by ZEON CORPORATION). Examples of polyester products include FINETEX ES650, 611, 675 and 850 (produced by Dainippon Ink & Chemicals, Inc.), and WD-size and WMS (produced by EASTMAN CHEMICAL). Examples of polyurethane products include HYDRAN AP10, 20, 30 and 40 (produced by Dainippon Ink & Chemicals, Inc.). Examples of rubber products include LACSTAR 7310K, 3307B, 4700H AND 7132C (produced by Dainippon Ink & Chemicals, Inc.), and Nipol Lx416, 410, 438C and 2507 (produced by ZEON CORPORATION). Examples of polyvinyl chloride products include G351 and G576 (produced by ZEON CORPORATION). Examples of polyvinylidene chloride products include L502 and L513 (produced by Asahi Kasei Corporation). Examples of polyolefin products include Chemipearl S120 and SA100 (produced by Mitsui Chemicals, Inc.).

The polymer latices may be used alone, or two or more thereof may be blended, if desired.

As the polymer latex used in the invention, styrene-butadiene copolymer latex is preferred in particular. The ratio between styrene unit and butadiene unit in the copolymer is preferably from 40:60 to 95:5 by weight. Also, it is preferred that the total amount of styrene unit and but a diene unit is from 60 to 99 weight % of the copolymer. Further, the polymer latex preferably contains acrylic acid unit or methacrylic acid unit in an amount of 1 to 6 weight %, more preferably 2 to 5 weight %, based on the sum total of styrene and butadiene units. The incorporation of acrylic acid unit in the polymer latex is preferred.

Examples of styrene-butadiene-acid copolymer latex preferably used in the invention include the foregoing P-3 to P-8 and P-15, and LACSTAR-3307B, LACSTAR-7132C and Nipol Lx416 as the commercial products.

The Tg range of styrene-butadiene-acid copolymer latex is preferably from 10° C. to 30° C., more preferably from 17° C. to 25° C.

To the organic silver salt-containing layer of the photosensitive material may be added a hydrophilic polymer, such as gelatin, polyvinyl alcohol, methyl cellulose, hydroxypropyl cellulose or carboxymethyl cellulose. The amount of hydrophilic polymer added is preferably not greater than 30 weight %, more preferably not greater than 20 mass %, of the total binder in the organic silver salt-containing layer.

It is preferable that the organic silver salt-containing layer (or the image-forming layer) is a layer formed using polymer latex. The ratio of the total binder to the organic silver salt in the organic silver salt-containing layer is preferably from 1/10 to 10/1, more preferably from 1/3 to 5/1, still more preferably from 1/1 to 1/3, by weight.

Ordinarily, the organic silver salt-containing layer is also a light-sensitive layer (an emulsion layer) containing light-sensitive silver halide as light-sensitive silver salt. In such a case, the ratio of the total binder to the silver halide is preferably from 400/1 to 5/1, more preferably from 200/1 to 10/1, by weight.

The amount of total binder contained in the image-forming layer is preferably from 0.2 to 30 g/m$^2$, more preferably from 1 to 15 g/m$^2$, still more preferably from 2 to 10 g/m$^2$. To the image-forming layer may be added a cross-linking agent for crosslinking and a surfactant for improving coating property.

(Preferable Solvent for Coating Solution)

The solvent (herein, a solvent and a dispersing medium are both referred to as a solvent for simplicity's sake) suitably used in a coating solution for the organic silver salt-containing layer of the present photosensitive material is a water-based solvent containing at least 30 weight % water.

As a solvent component other than water, a water-miscible organic solvent, such as methyl alcohol, ethyl alcohol, isopropyl alcohol, methyl cellosolve, ethyl cellosolve, dimethylformamide and ethyl acetate, maybe appropriately used. The water content in the solvent for the coating solution is preferably at least 50 weight %, more preferably at least 70 weight %.

Preferred examples of the solvent composition include water=100, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5 (wherein all the figures are by weight %).

Now, the antifoggant usable in the invention is described.

The compounds disclosed in JP-A-10-62899, paragraph [0070], the compounds disclosed in EP-A-0803764, page 20, line 57, to page 21, line 7, the compounds disclosed in JP-A-9-281637 and JP-A-9-329864, the compounds disclosed in U.S. Pat. No. 6,083,681 and European Patent No. 1048975 can be used as the antifoggant, stabilizer and precursor of stabilizer in the invention.

In addition, the antifoggant preferably used in the invention is an organic halogen compound. Examples of the organic halogen compound include the compounds disclosed in JP-A-11-65021, paragraphs [0111] and [0112]. In particular, the organic halogen compounds represented by formula (P) in JP-A-2000-284399, the organic polyhalogen compounds represented by formula (II) in JP-A-10-339934, and the organic polyhalogen compounds disclosed in JP-A-2001-31644 and JP-A-2001-33911 are preferred.

The organic polyhalogen compound preferably used in the invention is illustrated below.

The polyhalogen compound preferred in the invention includes a compound represented by the following formula (H):

$$Q\text{-}(Y)_N\text{—}C(Z_1)(Z_2)X \qquad (H)$$

In formula (H), Q represents an alkyl group, an aryl group or a heterocyclic group, Y represents a divalent connecting group, N represents 0 or 1, $Z_1$ and $Z_2$ each represent a halogen atom, and X represents a hydrogen atom or an electron attractive group.

Preferably, Q in formula (H) represents a phenyl group substituted with an electron attractive group whose Hammett's substituent constant up takes on a positive value. For details of the Hammett's substituent constant, *Journal of Medicinal Chemistry*, vol. 15, No. 11, pages 1207–1216 (1973) can be referred to.

Examples of the electron attractive group include a halogen atom (e.g., fluorine atom (σp value: 0.06), chlorine atom (σp value: 0.23), bromine atom (σp value: 0.23), iodine atom (σp value: 0.18)), a trihalomethyl group (e.g., tribromomethyl (σp value: 0.29), trichloromethyl (σp value: 0.33), trifluoromethyl (σp value: 0.54)), a cyano group (σp value: 0.66), a nitro group (σp value: 0.78), an aliphatic sulfonyl group (e.g., methanesulfonyl (σp value: 0.72)), an arylsulfonyl group, a heterocyclicsulfonyl group, an aliphatic acyl group (e.g., acetyl (σp value: 0.50)), an arylacyl group (e.g., benzoyl (σp value: 0.43)), a heterocyclic acyl group, an alkynyl group (e.g., —C≡CH (σp value: 0.23)), an aliphatic oxycarbonyl group (e.g., methoxycarbonyl (σp value: 0.45)), an aryloxycarbonyl group (e.g., phenoxycarbonyl (σp value: 0.44)), a heterocyclic oxycarbonyl group, a carbamoyl group (σp value: 0.36),a sulfamoyl group (σp value: 0.57), a sulfoxide group, a heterocyclic group, and a phosphoryl group. The up value is preferably in the range of 0.2 to 2.0, more preferably 0.4 to 1.0.

Of the electron attractive groups, a carbamoyl group, an alkoxycarbonyl group, an alkylsulfonyl group and an alkylphosphoryl group are preferred. In particular, a carbamoyl group is preferred.

X is preferably an electron attractive group, more preferably a halogen atom, an aliphatic sulfonyl group, an arylsulfonyl group, a heterocyclic sulfonyl group, analiphatic acyl group, an arylacyl group, a heterocyclic acyl group, an aliphatic oxycarbonyl group, an aryloxycarbonyl group, a heterocyclic oxycarbonyl group, a carbamoyl group or a sulfamoyl group, particularly preferably a halogen atom. Of the halogen atoms, chlorine, bromine and iodine atoms are preferred, chlorine and bromine atoms are more preferred, and a bromine atom is particularly preferred.

Y is preferably —C(=O)—, —SO— or —$SO_2$—, more preferably —C(=O)— or —$SO_2$—, particularly preferably —$SO_2$—.

N is 0 or 1, preferably 1.

Examples of the compound represented by formula (H) used in the invention are illustrated below.

(III-1)

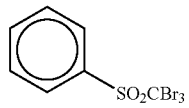

(III-2)

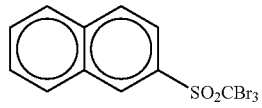

(III-3)

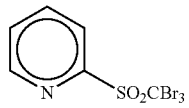

(III-4)

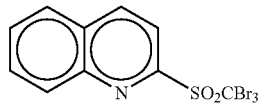

(III-5)

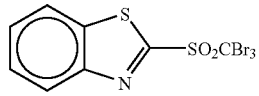

(III-6)

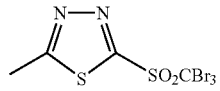

(III-7)

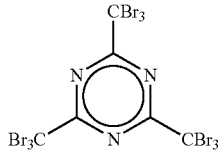

(III-8)

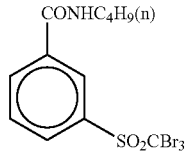

(III-9)

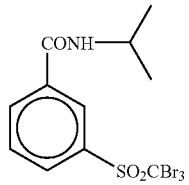

(III-10)

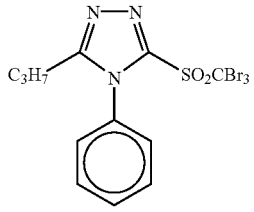

-continued (III-11)

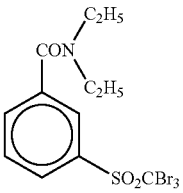

(III-12)

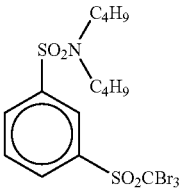

(III-13)

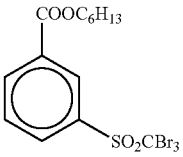

(III-14)

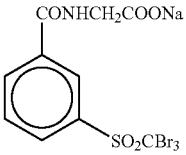

(III-15)

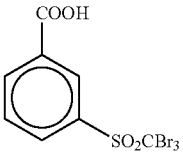

(III-16)

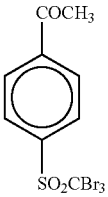

(III-17)

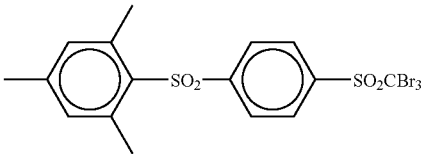

(III-18)

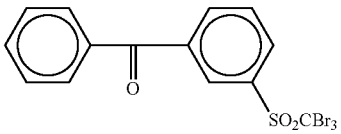

(III-19)

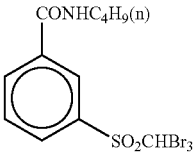

-continued (III-20)

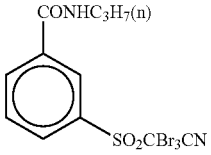

(III-21)

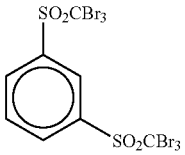

(III-22)

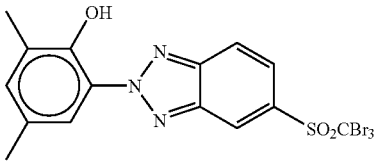

(III-23)

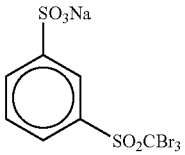

(III-24)

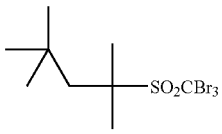

The compound represented by formula (H) in the invention is used preferably in an amount of $1\times10^{-4}$ to 0.5 mole, more preferably $1\times10^{-3}$ to 0.1 mole, still more preferably $5\times10^{-3}$ to 0.05 mole, per mole of the light-insensitive silver salt in the image-forming layer.

As a method of incorporating the antifoggant into the photosensitive material, the methods as described above for the reducing agent can be adopted. Specifically, the method of adding in the form of a fine particulate solid dispersion is also preferable for the organic polyhalogen compound.

Examples of other antifoggants include the mercury(II) salts disclosed in JP-A-11-65021, paragraph [0113], the benzoic acids disclosed in JP-A-11-65021, paragraph [0114], the salicylic acid derivatives disclosed in JP-A-2000-206642, the formaldehyde scavenger compounds represented by formula (S) in JP-A-2000-221634, the triazine compounds relating to claim 9 of JP-A-11-352624, the compounds represented by formula (III) in JP-A-6-11791 and 4-hydroxy-6-methyl-1,3,3a,7-tetraazaindene.

The present heat-developable photosensitive material may contain an azolium salt for the purpose of fog prevention. Examples of the azolium salt include the compounds of formula (XI) disclosed in JP-A-59-193447, the compounds disclosed in JP-B-55-12581, and the compounds of formula (II) disclosed in JP-A-60-153039. The azolium salt, though may be added to any region of the photosensitive material, is preferably added to a layer present on the light-sensitive layer side. More preferably, it is added to the organic silver salt-containing layer.

The addition of azolinium salt may be carried out at any step in the preparation of a coating solution. In the case of adding itm to the organic silver salt-containing layer, the addition timing may be any step in the process from organic silver salt preparation to coating solution preparation, but preferably during the period from the conclusion of organic silver salt preparation to just before the coating. The azolium salt may be added by any method, such as a method of adding in the form of powder, a solution or a fine-particle dispersion. It may also be added as a solution of a mixture with other additives, such as a sensitizing dye, a reducing agent or a toning agent.

The amount of azolium salt added in the invention, though may be any value, is preferably from $1\times10^{-6}$ mole to 2 moles, more preferably from $1\times10^{-3}$ mole to 0.5 moles, per mole of silver.

In the present photosensitive material, a mercapto compound, disulfide compound and thione compound can be contained for the purposes of controlling the development through retardation or acceleration, enhancing the efficiency of spectral sensitization and improving the preservability before and after the development. The compounds include the compounds disclosed in JP-A-10-62899, paragraphs [0067] to [0069], the compounds represented by formula (I) in JP-A-10-186572 and their examples recited in paragraphs [0033] to [0052], and the compounds disclosed in EP-A-0803764, page 20, lines 36–56. In particular, the mercapto-substituted aromatic heterocyclic compounds as disclosed in JP-A-9-297367, JP-A-9-304875 and JP-A-2001-100358 are preferable.

The plasticizers and the lubricants described in JP-A-11-65021, paragraph [0117], can be used in the present light-sensitive layer. The ultra-high contrast-providing agent for formation of ultra-high contrast images and the addition method and amount thereof, which can be applied to the present light-sensitive layer, are described in JP-A-11-65021, paragraph [0118], JP-A-11-223898, paragraphs [0136] to [0193], and further include the compounds represented by formula (H), formulae (1) to (3), formulae (A) and (B) respectively in JP-A-2000-284399 and the compounds represented by formulae (III) to (V) respectively (specifically, Compounds of [Ka-21] to [Ka-24]) in JP-A-2000-347345. The ultra-high contrast accelerators which can be used in the present light-sensitive layer include those described in JP-A-11-65021, paragraph [0102], and JP-A-11-223898, paragraphs [0194] and [0195].

In order that formic acid or a salt thereof serves as a strong fogging substance, it is preferably used in an amount of 5 millimoles or below, more preferably 1 millimole or below, per mole of silver on the side where the image-forming layer containing light-sensitive silver halides is present.

When the ultra-high contrast-providing agent is used in the present heat-developable photosensitive material, it is preferable to use an acid formed by hydration of diphosphorus pentoxide or a salt thereof in combination therewith.

Examples of the acid formed by hydration of diphosphorus pentoxide and salt thereof include metaphosphoric acid (metaphosphate), pyrophosphoric acid (pyrophosphate), orthophosphoric acid (orthophosophate), triphosphoric acid (triphosphate), tetraphosphoric acid (tetraphosphate), and hexametaphosphoric acid (hexametaphosphate).

Of the acid formed by hydration of diphosphorus pentoxide and salt thereof, orthophosphoric acid (orthophosphate) and hexametaphosphoric acid (hexametaphosphate) are particularly preferably used.

Specific examples of the salt include sodium orthophosphate, sodium dihydrogen orthophosphate, sodium hexametaphosphate and ammonium hexametaphosphate.

The amount of the acid formed by hydration of diphosphorus pentoxide and salt thereof (coverage per m of the photosensitive material) may be appropriately determined considering characteristics such as sensitivity and fog. Specifically, the amount is preferably from 0.1 to 500 mg/m$^2$, more preferably from 0.5 to 100 mg/m$^2$.

The present heat-developable photosensitive material can have a surface protective layer for the purpose of preventing adhesion of the image-forming layer. The surface protective layer may be a single layer or a multiple layer. Detailed descriptions of the protective layer can be found in JP-A-11-65021, paragraphs [0119] and [0120], and JP-A-2000-171936.

As a binder of the present surface protective layer, gelatin is preferable. In addition, it is also preferred to use polyvinyl alcohol (PVA) alone or in combination with gelatin. As to the gelatin used, inert gelatin (e.g. Nitta Gelatin 750) and phthalated gelatin (e.g., Nitta Gelatin 801) are usable.

Examples of PVA usable include those disclosed in JP-A-2000-117936, paragraphs [0009] to [0020], preferably PVA-105 as a completely saponified product, PVA-205 and PVA-335 as partially saponified products, and MP-203 as a modified polyvinyl alcohol product (which all are trade names and available from Kuraray Co., Ltd.).

The polyvinyl alcohol coverage (per m$^2$ of a support) for each of the protective layer is preferably from 0.3 to 4.0 g/m$^2$, more preferably from 0.3 to 2.0 g/m$^2$.

In the case where the present heat-developable light-sensitive layer is used for printing purpose wherein dimensional stability becomes significant in particular, it is preferable to use polymer latex in the surface protective layer or a backing layer.

Descriptions of the polymer latex can be found, e.g., in *Gousei Jushi Emulsion*, compiled by Taira Okuda & Hiroshi Inagaki, Koubunshi Kankoukai (1978), *Gousei Latex no Ouyou*, compiled by Takaaki Sugimura, Yasuo Kataoka, Souichi Suzuki & Keishi Kasahara, Koubunshi Kankoukai (1993), and Gousei Latex no Kagaku, compiled by Souichi Muroi, Koubunshi Kankoukai (1970). Examples of usable polymer latex include latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate/methacrylic acid copolymer, latex of methyl methacrylate (58.9 weight %)/2-ethylhexyl acrylate (25.4 weight %)/styrene (8.6 weight %)/2-hydroxyethyl methacrylate (5.1 weight %)/acrylic acid (2.0 weight %) copolymer, and latex of methyl methacrylate (64.0 weight %)/styrene (9.0 weight %)/butyl acrylate (20.0 weight %)/2-hydroxyethyl methacrylate (5.0 weight %)/acrylic acid (2.0 weight %) copolymer.

To the binders of the surface protective layer may be applied the arts disclosed in JP-A-2000-267226, paragraphs [0021] to [0025], and the arts disclosed in JP-A-2000-19678, paragraphs [0023] to [0041].

In the surface protective layer, the content of polymer latex is preferably 10 to 90 weight %, particularly preferably 20 to 80 weight %, based on the total binder.

The coverage (per m2 of a support) of the total binder (including water-soluble binder and latex polymer) for each of the surface protective layer is preferably from 0.3 to 5.0 g/m$^2$, more preferably from 0.3 to 2.0 g/m$^2$.

The preparation temperature of the coating solution for the present image-forming layer is preferably from 30° C. to 65° C., more preferably from 35° C. to 60° C., still more preferably 35° C. to 55° C. It is also preferred that the temperature of the coating solution for the image-forming layer just after the addition of polymer latex is kept at a temperature of from 30° C. to 65° C.

The present image-forming layer is provided on a support, and constituted of one or more layers. When it has one constituent layer, the present image-forming layer contains an organic silver salt, light-sensitive silver halide, a reducing agent and a binder, and additional ingredients including a toning agent, a coating aid and other auxiliary agents, if desired. When the image-forming layer has two or more constituent layers, the first image-forming layer (ordinarily the layer adjacent to a support) contains an organic silver salt and light-sensitive silver halide, and the second image-forming layer or both first and second image-forming layers contain other ingredients.

In the case of a multicolor, light-sensitive heat-developable photographic material, the photographic material may have a combination of the two layers for each color or, as disclosed in U.S. Pat. No. 4,708,928, may contain all the ingredients in a single layer. In the case of a multi-dye, multicolor, light-sensitive, heat-developable photographic material, as described in U.S. Pat. No. 4,469,681, each adjacent pair of emulsion layers are kept distinctively by providing a functional or non-functional barrier layer between the light-sensitive layers.

In the present light-sensitive layer, various kinds of dyes and pigments (such as C.I. Pigment Blue 60, C.I. Pigment Blue 64, C.I. Pigment Blue 15:6) can be used from the viewpoints of improvement of tone, prevention of interference pattern formation upon exposure to laser light and prevention of irradiation. Detailed descriptions thereof can be found in WO 98/36322, JP-A-10-268465 and JP-A-11-338098.

In the present heat-developable photosensitive material, it is preferable to arrange an anti-halation layer at a location distant from a light source relative to the light-sensitive layer.

The heat-developable photosensitive material ordinarily has a light-insensitive layer in addition to the light-sensitive layer. According to its location, the light-insensitive layer is classified under four groups, namely (1) a protective layer provided on a light-sensitive layer (distant from a support), (2) an interlayer provided between adjacent light-sensitive layers or between a light-sensitive layer and a protective layer, (3) an undercoat layer provided between a support and a light-sensitive layer and (4) a backing layer provided on the side opposite to the light-sensitive layer. A filter layer is provided in the photosensitive material as a layer classified as the group (1) or (2), and an anti-halation layer is provided in the photosensitive material as a layer classified as the group (3) or (4).

Descriptions of the anti-halation layer can be found in JP-A-11-65021, paragraphs [0123] and [0124], JP-A-11-223898, JP-A-9-230531, JP-A-10-36695, JP-A-10-104779, JP-A-11-231457, JP-A-11-352625 and JP-A-11-352626.

The anti-halation layer contains anti-halation dye showing absorption at wavelength of light for exposure. As laser having its wavelength peak in the range of 350 nm to 440 nm is used for the exposure in the invention, it is preferred to use a dye capable of absorbing light of such a wavelength.

When the prevention of halation is performed with a dye showing absorption in the visible region, it is preferred that substantially no color of the dye is present after the image formation and, therefore, to take a measure for decolouration by heat of heat development. In particular, it is preferable to add a thermally discoloring dye and a base precursor to a light-insensitive layer and make the light-insensitive layer function as anti-halation layer. These arts are described in JP-A-11-231457.

The amount of decolouring dye added is determined depending on usage of the dye ordinarily, the decolouring dye is used preferably in an amount for providing an optical density (absorbance) higher than 0.1, measured at the intended wavelength. The optical density is preferably from 0.15 to 2, and more preferably from 0.2 to 1. In order to attain such an optical density, the amount of a dye used is ordinarily approximately from 0.01 to 1 g/m$^2$.

By discolouring the dye appropriately, the optical density after the heat development can be lowered to 0.1 or below. Two or more discolouring dyes may be used together in a thermal discolouration type recording material or a heat-developable photosensitive material. Also, two or more base precursors may be used together.

In the thermal discolouration using such a discolouring dye and a base precursor, it is preferred to use a substance capable of lowering a melting point by 3° C. (deg) or more when mixed with the base precursor as disclosed in JP-A-11-352626 (e.g., diphenylsulfone, 4-chlorophenyl(phenyl) sulfone), or 2-naphthylbenzoate from the viewpoint of thermal discolouration capability.

For the purpose of improving the tone of silver and change of the image with a lapse of time, a coloring agent having its absorption maximum in the wavelength region of 300 to 450 nm can be added in the invention. Such coloring agents are disclosed in JP-A-62-210458, JP-A-63-104046, JP-A-63-103235, JP-A-63-208846, JP-A-63-306436, JP-A-63-314535, JP-A-01-61745 and JP-A-2001-100363.

The coloring agent is ordinarily added in an amount of 0.1 mg/m$^2$ to 1 g/m$^2$, and a layer to which it is added is preferably a backing layer provided on the side opposite to light-sensitive layer.

The heat-developable photosensitive material according to the invention is preferably a so-called single-sided photosensitive material, namely a photosensitive material having on one side of a support a light-sensitive layer containing at least a silver halide emulsion and on the other side a backing layer.

In the invention, addition of a matting agent is preferable for the purpose of improving suitability for conveyance. Descriptions of the matting agent can be found in JP-A-11-65021, paragraphs [0126] and [0127]. The amount of matting agent added is preferably from 1 to 400 mg, more preferably from 5 to 300 mg, per m$^2$ of photosensitive material.

The shape of matting agent used in the invention may be a regular or irregular shape, but preferably a regular shape, especially a spherical shape. The average diameter of particles is preferably from 0.5 to 10 μm, more preferably from 1.0 to 8.0 μm, still more preferably from 2.0 to 6.0 μm. The variation coefficient of particle size distribution is preferably 50% or below, more preferably 40% or below, still more preferably 30% or below. The term "variation coefficient" used herein means a value represented by (standard deviation of particle diameter)/(average value of particle diameter)×100. Further, it is preferred to use two matting agents having small variation coefficients and average diameter ratio of at least 3.

The emulsion layer surface may have any matting degree so far as it causes no stardust defect, but it has preferably Bekk smoothness of 30 to 2,000 seconds, especially 40 to 1,500 seconds. The Bekk smoothness can be easily determined in conformance with Japanese Industrial Standards (JIS) P8119, entitled "Paper and Paper Board Smoothness Testing Method by Bekk Smoothness Tester", and TAPPI Standard Method T479.

The matting degree of the back layer surface in the invention is preferably from 1,200 to 10 seconds, more preferably from 800 to 20 seconds, still more preferably from 500 to 40 seconds, in terms of Bekk smoothness.

In the invention, it is preferred that the matting agent is contained in the outermost surface layer, a layer functioning as the outermost surface layer, or a layer near the outer surface. It is also preferred to add the matting agent to a layer functioning as the so-called protective layer.

Back layers applicable to the invention are described in JP-A-11-65021, paragraphs [0128] to [0130].

In the present heat-developable photosensitive material, a pH on the surface before heat-development processing is preferably 7.0 or below, more preferably 6.6 or below. The pH on the surface has no particular lower limit, but it is of the order of 3. The most preferable pH range on the surface is from 4 to 6.2.

For adjustment of the pH on the surface, an organic acid such as a phthalic acid derivative, a nonvolatile inorganic acid such as sulfuric acid, or a volatile base such as ammonia is used preferably from the viewpoint of decreasing the pH on the surface. In particular, ammonia is preferable for attaining a low pH value on the surface because it is easy to volatilize and to remove at the coating step or before heat development.

In addition, the combined use of ammonia with a nonvolatile base, such as sodium hydroxide, potassium hydroxide or lithium hydroxide, is also preferred. As a method of measuring the pH on the surface, the method described in JP-A-11-87297, paragraph [0123] can be adopted.

A hardener may be used in each of the present constituent layers, such as the light-sensitive layer, protective layer and back layer. There are many hardening methods as described in T. H. James, *THE THEORY OF THE PHOTOGRAPHIC PROCESS FOURTH EDITION*, pages 77–87, Macmillan Publishing Co., Inc., and a wide variety of hardeners can be used. Preferable examples thereof include chrome alum, sodium salt of 2,4-dichloro-6-hydroxy-s-triazine, N,N-ethylenebis(vinylsulfonacetamide), N,N-propylenebis (vinylsulfonacetamide), the polyvalent metal ions as described in the book cited above, page 78, the polyisocyanates as disclosed in U.S. Pat. No. 4,281,060 and JP-A-6-208193, the epoxy compounds as disclosed in U.S. Pat. No. 4,791,042, and the vinylsulfone compounds as disclosed in JP-A-62-89048.

Such a hardener is added as a solution, and the suitable timing at which the solution is added to a coating solution for a protective layer is from 180 minutes before to just before the start of coating, preferably from 60 minutes to 10 seconds before the start of coating. There are no restrictions on the method and the condition for mixing the hardener in the coating solution so far as the effects of the invention can be fully produced.

As specific mixing methods, there are known the mixing method using a tank controlled so that the average stay time calculated from the rate of liquid flow added to the tank and the volume of the liquid sent into a coater becomes the desired value, and the method of using a static mixer as described in N. Harnby, M. F. Edwards & A. W. Nienow, "Ekitai Kongou Gijutsu", Chapter 8 (translated by Koji Takahashi), Nikkan Kogyo Shinbun-sha (1989).

Surfactants usable in the invention include those disclosed in JP-A-11-65021, paragraph [0132], solvents usable in the invention include those disclosed in ibid., paragraph [0133], supports usable in the invention include those disclosed in ibid., paragraph [0134], anti-static or conductive layers applicable to the invention include those disclosed in ibid., paragraph [0135], color image formation methods applicable to the invention include those disclosed in ibid., paragraph [0136], and lubricants usable in the invention include those disclosed in JP-A-11-84573, paragraphs [0061] to [0064], and JP-A-2001-83679, paragraphs [0049] to [0062].

It is preferred for the present photosensitive material to have a conductive layer containing a metal oxide. As a conductive material contained in the conductive layer, metal oxides in which oxygen defects or foreign metal atoms are introduced and thereby increased in conductivity are preferably used.

Preferable metal oxides include ZnO, $TiO_2$ and $SnO_2$. The addition of Al and In to ZnO, that of Sb, Nb, P and halogen elements to $SnO_2$, and that of Nb and Ta to $TiO_2$ are preferred. In particular, $SnO_2$ to which Sb is added is preferably used.

The amount of foreign atom added is preferably from 0.01 to 30 mole %, more preferably from 0.1 to 10 mole %. The metal oxide used may have any of spherical, acicular and tabular shapes. From the viewpoint of effectiveness of imparting conductivity, however, acicular grain having major axis/minor axis ratio of at least 2.0, preferably 3.0 to 50, is advantageously used.

The amount of metal oxide used is preferably from 1 to 1,000 mg/m$^2$, more preferably from 10 to 500 mg/m$^2$, still more preferably from 20 to 200 mg/m$^2$. The conductive layer may be arranged on the emulsion layer side or the back layer side, but preferably it is disposed between a support and a back layer. Specific examples of the conductive layer usable in the invention are described in JP-A-7-295146 and JP-A-11-223901.

In the invention, it is preferable to use a fluorine-containing surfactant. Examples of the fluorine-containing surfactant usable include the compounds disclosed in JP-A-10-197985, JP-A-2000-19680 and JP-A-2000-214554. The fluorine-containing polymer surfactants disclosed in JP-A-9-281636 are also used preferably. In particular, the fluorine-containing surfactants disclosed in JP-A-2002-82411 are preferred in the invention.

The transparent support preferable for the invention is polyester, especially polyethylene terephthalate, which has undergone heat treatment in a temperature range of 130 to 185° C. for the purposes of lessening internal strains remaining in the film upon biaxial stretch and eliminating the distortion caused by thermal shrinkage during the heat development. In the case of a heat-developable photosensitive material for medical use, the transparent support may be colored with a blue dye (e.g., Dye-1 used in Example of JP-A-8-240877), or it may be colorless.

To the support are preferably applied undercoat arts using the water-soluble polyester disclosed in JP-A-11-84574, the styrene-butadiene copolymer disclosed in JP-A-10-186565 and the vinylidene chloride copolymers disclosed in JP-A-2000-39684 and JP-A-2001-83679, paragraphs [0063] to [0080], respectively.

To the anti-static layer and the undercoat layer can be applied the arts disclosed in JP-A-56-143430, JP-A-56-143431, JP-A-58-62646, JP-A-56-120519, JP-A-11-84573, paragraphs [0040] to [0051], U.S. Pat. No. 5,575,957, and JP-A-11-223898, paragraphs [0078] to [0084].

The heat-developable photosensitive material is preferably a mono-sheet type (or a type which forms images in the heat-developable photosensitive material without using another sheet such as an image-receiving material).

To the heat-developable photosensitive material may further be added an antioxidant, a stabilizer, a plasticizer, an ultraviolet absorbent and a coating aid. These additives are added to either of light-sensitive and light-insensitive layers. For details of these additives WO 98/36322, EP-A-803764, JP-A-10-186567 and JP-A-10-18568 can be referred to.

In preparing the heat-developable photosensitive material, any coating method may be adopted. More specifically, a wide variety of coating operations including extrusion coating, slide coating, curtain coating, dip coating, knife coating, flow coating and the extrusion coating using a hopper as disclosed in U.S. Pat. No. 2,681,294 can be applied. Moreover, the extrusion coating and the slide coating techniques described in Stephen F. Kistler & Petert M. Schweizer, *LIQUID FILM COATING*, pages 399–536, CHAPMAN & HALL CO. (1997) are preferably applied. In particular, the slide coating techniques are preferably used. Examples of the shape of a slide coater usable in the slide coating operation are illustrated in the book cited above, FIG. 11*b*.1 on page 427. Further, if desired, simultaneous coating of two or more layers may be performed in accordance with the methods as described in the book cited above, pages 399–536, U.S. Pat. No. 2,761,791 and British Patent No. 837,095.

The coating solution for the present organic silver salt-containing layer is preferably the so-called thixotropic fluid. For the art of forming such a fluid JP-A-11- 52509 can be referred to.

The coating solution for the organic silver salt-containing layer has preferably a viscosity of 400 to 100,000 mPa·s, more preferably 500 to 20,000 mPa·s, at a shear rate of 0.1 $S^{-1}$. The viscosity of the coating solution at a shear rate of 1,000 $S^{-1}$ is preferably from 1 to 200 mPa·s, more preferably from 5 to 80 mPa·s.

To the present heat-developable photosensitive material can be also applied the arts disclosed in EP-A-803764, EP-A-883022, WO 98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807r JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-1-84574, JP-A-1165021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11338099, JP-A-11-343420, JP-A-2000-187298, JP-A-2000-10229, JP-A-2000-47345, JP-A-2000-206642, JP-A-2000-98530, JP-A-2000-98531, JP-A-2000-112059, JP-A-2000-112060, JP-A-2000-112104, JP-A-2000-112064 and JP-A-2000-171936.

For the purpose of controlling changes caused in photographic properties when the present photosensitive material is stored in a condition of raw film, or improving the resistance of the present photosensitive material to curl and core set, it is preferred to wrap the raw film in a wrapping material having a low oxygen-permeability and/or a low moisture-permeability.

The oxygen-permeability of the wrapping material is preferably at most 50 ml/atm·$m^2$·day, more preferably at most 10 ml/atm·$m^2$·day, still more preferably at most 1.0 ml/atm·$m^2$·day, measured at 25° C. The moisture-permeability is preferably at most 10 g/atm·$m^2$·day, more preferably at most 5 g/atm·$m^2$·day, still more preferably at most 1 g/atm·$m^2$·day.

Examples of the wrapping material having such low oxygen- and/or moisture-permeability include the wrapping materials disclosed in JP-A-8-254793 and JP-A-2000-206653.

The present heat-developable photosensitive material may be developed by any method, but it is ordinarily developed by temperature rise after the imagewise exposure. The temperature for development is preferably from 80° C. to 250° C., more preferably from 100° C. to 140° C., still more preferably from 110° C. to 130° C. The development time is preferably from 1 to 60 seconds, more preferably from 3 to 30 seconds, still more preferably from 5 to 25 seconds, particularly preferably from 7 to 15 seconds.

The heat development may be performed in a way of using a drum heater or a plate heater, but the way of using a plate heater is preferred in the invention. To the heat development using a plate heater, it is preferable to apply the method disclosed in JP-A-11-133572. More specifically, the method uses a heat-development apparatus that enables conversion of latent images formed in the heat-developable photosensitive material into visible images by bringing the photosensitive materials into contact with a heating means installed in the heat-development section. The apparatus is characterized in that the heating means installed therein is a plate heater, a plurality of pressing rollers are opposed along one surface of the plate heater and the heat-developable photosensitive material is made to pass between the plate heater and the pressing rollers, thereby effecting the heat development. It is preferable that the plate heater is two- to six-segmented and the temperature of each end segment is reduced by the order of 1 to 10° C.

For instance, a case can be used where a quartet of plate heaters capable of independent temperature control is used and these plate heaters are adjusted to temperatures of 112° C., 119° C., 121° C. and 120° C., respectively. Such a way of heating is described in JP-R-54-30032, and can remove the moisture and the organic solvent contained in the heat-developable photosensitive material into the outside of the photosensitive material and moreover control a support shape change caused by an abrupt heating of the heat-developable photosensitive material.

The present photosensitive material can fully exhibit its characteristics in the case of short exposure to light of high illumination intensity not lower than 1 mW/$mm^2$. When the exposure is performed at such high illumination intensity, the present heat-developable material containing the high silver iodide content silver halide emulsion of the invention and light-insensitive organic silver salt can attain sufficient sensitivity. In other words, the exposure to light of high illumination intensity can provide high sensitivity in the invention, compared with exposure to light of low illumination intensity.

The illumination intensity is preferably from 2 mW/$mm^2$ to 50 W/$mm^2$, and more preferably from 10 mW/$mm^2$ to 50 W/$mm^2$.

Any light source may be used as far as it has illumination intensity in the aforementioned range. The foregoing conditions can be preferably achieved by use of laser light.

Examples of the laser light preferably used in the invention include gas laser ($AR^+$, KR), YAG laser, dye laser and semiconductor laser. In addition, a combination of laser and a second harmonic device can be used. Of the lasers, semiconductor lasers emitting blue to violet rays are preferred. In particular, semiconductor lasers having the peak of light emission intensity in the wavelength region of 350 nm to 450 nm, especially 390 nm to 430 nm, are preferably used. As an example of high-power, blue to violet light-emitting semiconductor lasers, a semiconductor laser NLHV3000E produced by NICHIA CORPORATION can be exemplified.

The laser emitting light with a wavelength of 405 nm and a power of 35 mW is disclosed. By using the laser like this, high illumination intensity light with wavelengths of 390 nm to 430 nm particularly preferable for the invention can be obtained.

As a medical laser imager provided with an exposure section and a heat development section, Fuji Medical Dry Laser Imager FM-DP L can be used.

The model FM-DP L is described in *Fuji Medical Review*, No. 8, pp. 39–55. The arts disclosed therein are applied to a laser imager used for the present heat-developable photosensitive material. Further, the present heat-developable photosensitive material can also be utilized as a heat-developable photosensitive material for the laser imager in "AD Network" which Fuji Medical System offers as a network system compliant with the DICOM standard.

The present heat-developable photosensitive material forms black-and-white images based on silver images, and preferably used as a heat-developable photosensitive material for medical diagnosis, industrial photography, graphic art and COM purpose.

Now, the invention is described in more detail by reference to the following examples, but these examples should not be construed as limiting the scope of the invention in any way.

EXAMPLE 1

Experiment 1: Production of Heat-Developable Photosensitive Material 1

(Production of PET Support)

PET having intrinsic viscosity (IV) of 0.66 (measured in a 6:4 (by weight) mixture of phenol and tetrachloroethane at 25° C.) was produced using terephthalic acid and ethylene glycol in a usual manner. The PET obtained was shaped into pellets, dried at 130° C. for 4 hours, and then molten at 300° C. Into the molten PET, 0.04 wt % of Dye BB of the following structural formula was mixed. Thereafter, it was extruded from a T die and quenched, thereby forming a unstretched film having such a thickness as to provide a thickness of 175 μm after thermal setting.

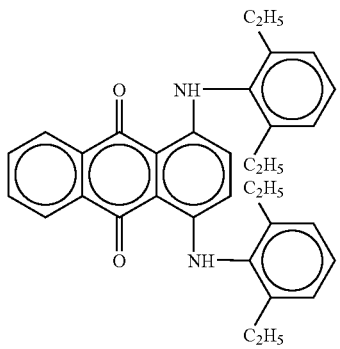

Dye BB

The film was stretched to 3.3 times its original length by means of rollers differing in peripheral speed, and then stretched on a tenter to 4.5 times its original width. The temperatures during these stretching operations were 110° C. and 130° C., respectively. Thereafter, the film was thermally set at 240° C. for 20 seconds and further, under the same temperature, subjected to 4% relaxation in a lateral direction. Then, the part corresponding to the tenter's chuck was slit off, and the both sides underwent knurl processing. The thus processed film was wound under a tension of 4 kg/cm$^2$ to form a roll of 175 μm-thick film.

(Surface Corona Processing)

By means of a solid-state corona processor, Model 6 KVA, made by Pillar Technologies, both surfaces of the support was processed at a rate of 20 m/min at room temperature. From the readout numbers of current and voltage under this operation, the processing the support underwent was calculated to be 0.375 kV-A-min/m$^2$. In addition, the processing frequency and the gap clearance between the electrode and the dielectric roll under this operation were 9.6 kHz and 1.6 mm., respectively.

(Production of Support with Undercoat Layer)

<<Preparation of Coating Composition for Undercoat Layer>>

| | |
|---|---|
| Formula (i) (for undercoat layer on photosensitive layer side): | |
| Pesresin A-520 produced by TAKAMATSU OIL & FAT CO., LTD. (30 wt % solution) | 59 g |
| Polyethylene glycol monononyl phenyl ether (average number of ethylene oxide units = 8.5, 10 wt % solution) | 5.4 g |
| MP-1000, produced by Soken Chemical & Engineering Co., Ltd. (particulate polymer with an average particle size of 0.4 μm) | 0.91 g |
| Distilled water | 935 ml |
| Formula (ii) (for first layer on back side): | |
| Styrene-butadiene copolymer latex (solid content = 40 wt %, styrene/butadiene = 68/32 by weight) | 158 g |
| Sodium salt of 2,4-dichloro-6-hydroxy-s-triazine (8 wt % aqueous solution) | 20 g |
| Sodium laurylbenzenesulfonate (1 wt % aqueous solution) | 10 ml |
| Distilled water | 854 ml |
| Formula (iii) (for second layer on back side): | |
| $SnO_2$/SbO (9/1 by weight, average grain size 0.038 μm, 17 wt % dispersion) | 84 g |
| Gelatin (10 wt % aqueous solution) | 89.2 g |
| Metolose TC-5 produced by Shin-Etsu Chemical Co., Ltd. (2 wt % aqueous solution) | 8.6 g |
| MP-1000 produced by Soken Chemical & Engineering Co., Ltd. | 0.01 g |
| 1 wt % Aqueous solution of sodium dodecyl-benzenesulfonate | 10 ml |
| NaOH (1 wt %) | 6 ml |
| Proxel (produced by Imperial Chemical Industries PLC) | 1 ml |
| Distilled water | 805 ml |

After the corona discharge processing described above, the biaxially stretched 175 μm-thick polyethylene terephthalate support was coated on one side (photosensitive layer side) with the undercoating composition of formula (i) at a wet coverage of 6.6 ml/m$^2$ (per side) by means of a wire bar, and dried at 180° C. for 5 minutes. Subsequently thereto, it was coated on the other side (back side) with the undercoating composition of formula (ii) at a wet coverage of 5.7 ml/m$^2$ by means of a wire bar, and dried at 180° C. for 5 minutes, and further thereon with the undercoating composition of formula (iii) at a wet coverage of 7.7 ml/m$^2$ by means of a wire bar, and dried at 180° C. for 6 minutes. Thus, the support provided with the undercoat layers was produced.

(Preparation of Coating Composition on Back Side)

<<Preparation of Coating Composition for Anti-Halation Layer>>

For an anti-halation layer, a coating composition was prepared by mixing in 844 ml of water 17 g of gelatin, 9.6 g of polyacrylamide, 1.5 g of monodisperse fine particles of polymethyl methacrylate (average particle size: 8 μn, standard deviation of particle sizes: 0.4), 0.03 g of benzisothiazolinone, 0.1 g of Blue Dye Compound-1 and 0.1 g of Yellow Dye Compound-1.

<<Preparation of Coating Composition for Protective Layer on Back Side>>

In a vessel kept at 40° C. was prepared a coating composition for a protective layer on the back side by mixing 50 g of gelatin, 0.2 g of sodium polystyrenesulfonate, 2.4 g of N,N-ethylenebis(vinylsulfonacetamide), 1 g of sodium tert-octylphenoxyethoxyethanesulfonate, 30 mg of benzisothiazolinone, 37 mg of a fluorine-containing surfactant (F-1: potassium salt of N-perfluorooctylsulfonyl-N-propylalanine), 150 mg of a fluorine-containing surfactant (F-2: polyethylene glycol mono(N-perfluorooctylsulfonyl-N-propyl-2-aminoethyl) ether [average polymerization degree of ethylene oxide: 15]), 64 mg of a fluorine-containing surfactant (F-3), 32 mg of a fluorine-containing surfactant (F-4), 10 mg of a fluorine-containing surfactant (F-7), 5 mg of a fluorine-containing surfactant (F-8), 8.8 g of acrylic acid/ethyl acrylate copolymer (copolymerization ratio: 5/95 by weight), 0.6 g of Aerosol-OT (produced by American Cyanamid Co.), a liquid paraffin emulsion containing 1.8 g of liquid paraffin and 950 ml of water.

(Preparation of Silver Halide Emulsion)

<<Preparation of Silver Halide Emulsion 1>>

A solution prepared by adding 3.1 ml of a 1 wt % potassium bromide solution to 1420 ml of distilled water and then adding thereto 3.5 ml of diluted sulfuric acid with a concentration of 0.5 mole/L and 36.5 g of phthalated gelatin was placed in a reaction pot made of stainless steel, and kept at 30° C. with stirring. Thereto, Solution A prepared by diluting 22.22 g of silver nitrate to 95.4 ml with distilled water and Solution B prepared by diluting 15.3 g of potassium bromide and 0.8 g of potassium iodide to 97.4 ml with distilled water were added at constant flow rates in their entirety over a 45-second period. Thereafter, 10 ml of a 3.5 wt % aqueous solution of hydrogen peroxide was further added, followed by addition of 10.8 ml of a 10 wt % aqueous solution of benzimidazole.

Furthermore, Solution C prepared by diluting 51.86 g of silver nitrate to 317.5 ml with distilled water and Solution D prepared by diluting 44.2 g of potassium bromide and 2.2 g of potassium iodide to 400 ml with distilled water were added in a manner that the total amount of Solution C was added at a constant flow rate over a 20-minute period and Solution D was added in accordance with a controlled double jet (CDJ) method while keeping the pAg of the resultant mixture at 8.1. After a 10-minute lapse from the start of the addition of Solutions C and D, potassium hexachloroiridate (III) in an amount of $1\times10^{-4}$ mole per mole of silver was further added at once. Furthermore, after a 5-second lapse from the completion of addition of Solution C, an aqueous solution of potassium iron(II) hexacyanide in an amount of $3\times10^{-4}$ mole per mole of silver was added at once. The pH of the resultant reaction mixture was adjusted to 3.8 by the use of diluted sulfuric acid having a concentration of 0.5 mole/L. At this point there action mixture ceased to be stirred, and it was subjected successively to precipitation, desalting and washing operations.

Then, the pH adjustment to 5.9 was carried out by addition of an aqueous solution of NaOH having a concentration of 1 mole/L. Thus, a silver halide dispersion having a pAg of 8.0 was prepared.

The silver halide dispersion was kept at 38° C. with stirring and admixed with 5 ml of a 0.34 wt % methanol solution of 1,2-benzisothiazoline-3-one. Then, the temperature of the dispersion was raised to 47° C. After a 20-minute lapse from the temperature raise, a methanol solution of sodium benzenethiosulfonate was added in an amount of $7.6\times10^{-5}$ mole/mole silver. After a further lapse of 5 minutes, tellurium sensitizer C as a methanol solution was added thereto in an amount of $2.9\times10^{-4}$ mole per mole of silver. The resulting dispersion was ripened for 91 minutes.

The thus ripened dispersion was admixed with 1.3 ml of a 0.8 wt % methanol solution of N,N'-dihydroxy-N''-diethylmelamine. Thereto, after a 4-minute lapse, were further added $4.8\times10^{-3}$ mole/mole silver of 5-methyl-2-mercaptobenzimidazole as a methanol solution and $5.4\times10^{-3}$ mole/mole silver of 1-phenyl-2-heptyl-5-mercapto-1,3,4-triazole as a methanol solution and $8.5\times10^{-3}$ mole/mole silver of sodium 1-(3-methylureido)-5-mercaptotetrazole as an aqueous solution. Thus, silver halide Emulsion 1 was obtained.

The grains in the thus prepared silver halide emulsion were silver iodobromide grains having an average sphere equivalent diameter of 0.040 μm and a variation coefficient of 18% with respect to sphere equivalent diameter. For determination of such values concerning grain sizes, 1,000 grains were examined with an electron microscope, and the average thereof was calculated.

<<Preparation of Mixed Emulsion A for Coating Composition>>

The silver halide Emulsion 1 was dissolved, and thereto was added $7\times10^{-3}$ mole/mole silver of a 1 wt % aqueous solution of benzothiazolium iodide. Further, water was added thereto in an amount that the silver halide content became 38.2 g per kg of an mixed emulsion intended for a coating composition, and sodium salt of 1-(3-methylureido)-5-mercaptotetrazole was also added in an amount of 0.34 g per kg of the mixed emulsion.

<Preparation of Dispersion of Silver Salt of Fatty Acid>

Behenic acid (Edenor C22-85R, trade name, a product of Henkel Co.) in an amount of 87.6 kg was mixed with 423 L of distilled water, 49.2 L of an aqueous solution containing NaOH in a concentration of 5 mole/L and 120 L of tert-butanol, and stirred for one hour at 75° C. to prepare a sodium behenate solution. Separately, 206.2 L of an aqueous solution (pH 4.0) containing 40.4 kg of silver nitrate was prepared, and kept at 10° C. The reaction vessel in which 635 L of distilled water and 30 L of tert-butanol were placed was kept at 30° C. with vigorous stirring, and thereto the total amount of the foregoing sodium behanate solution and the total amount of the foregoing silver nitrate solution were added at their individual constant flow rates over a period of 93 minutes and 15 seconds and a period of 90 minutes, respectively.

More specifically, these two solutions were added in the following manner: The aqueous solution of silver nitrate alone was added for the period from the beginning of addition to a lapse of 11 minutes, then the sodium behenate solution began to be added, and further the addition of the sodium behenate solution alone was continued for a period of 14 minutes and 15 seconds after finishing the addition of aqueous silver nitrate solution. During the addition, the temperature inside the reaction vessel was maintained at 30° C. by controlling externally so that the mixed solution temperature was kept constant.

The jacketed pipe laid for feeding the sodium behenate solution was kept warm by circulating hot water through the outer part thereof, and the solution temperature at the exit of the addition nozzle tip was regulated at 75° C. As to the jacketed pipe laid for feeding the aqueous silver nitrate solution, the solution temperature was kept constant by circulating cold water through the outer part of the pipe. The nozzle tip from which the sodium behanate solution was fed and that from which the aqueous silver nitrate solution was fed were arranged symmetrically about the stirring axis, and situated above the reaction solution so as to avoid the contact of those solutions with the reaction solution.

After the addition of the sodium behenate solution was completed, the reaction solution was stirred for 20 minutes as the temperature thereof was kept unchanged, and then the solution temperature was raised to 35° C. over a 30-minute period. And the resulting solution was ripened for 210 minutes. Immediately after the ripening, the solid matter in the ripened solution was filtered off by centrifugal filtration, and washed with water till the filtrated water came to have a conductivity of 30 μS/cm. Thus, the silver salt of fatty acid was obtained. The solid matter obtained was stored as wet cake without undergoing any drying treatment.

The form of the thus produced silver behenate grains was evaluated by electron micrography. As a result, the grains were found to have the crystal form of scales, specifically with the average a value of 0.14 μm, the average b value of 0.4 μm, the average c value of 0.6 μm, the average aspect ratio of 5.2, the average sphere equivalent diameter of 0.52 μm and the variation coefficient of 15% with respect to the sphere equivalent diameters (wherein a, b and C have the same meanings as defined hereinbefore).

To the wet cake in an amount corresponding to 260 kg on a dry solid basis, 19.3 kg of polyvinyl alcohol (PVA-217, trade name, a product of Kuraray Co. Ltd.) was added. Further, water was added thereto in the amount to adjust the total weight of the resultant mixture to 1, 000 kg, and the mixture was made into slurry with dissolver blades and preliminary dispersed with a pipeline mixer (Model PM-10, made by MISUHO INDUSTRIAL CO., LTD.)

The thus preliminarily dispersed solution was processed three times by using a dispersing machine, Microfluidizer M-610 (trade name, a product of Microfluidex International Corporation, wherein Z-type interaction chamber was used), under the pressure adjusted to 1260 kg/cm$^2$, thereby preparing a dispersion of silver behenate. The dispersion temperature was set at 18° C. by mounting coiled heat exchangers on the front and the rear of interaction chamber respectively, and controlling the temperature of the coolant used therein.

(Preparation of Reducing Agent Dispersion)

<<Preparation of Dispersion of Reducing Agent-2>>

Water in amount of 10 kg was added to and thoroughly mixed with 10 kg of Reducing Agent-2 (6,6'-di-tert-butyl-4,4'-dimethyl-2,2'-butylidenedipehnol) and 16 kg of a 10 wt % aqueous solution of modified polyvinyl alcohol (Poval MP-203, produced by Kuraray Co., Ltd.), thereby preparing a slurry.

The slurry was fed by means of a diaphragm pump into a horizontal sand mill (Model UVM-2, made by IMEX Co., Ltd.) packed with zirconia beads having an average diameter of 0.5 mm, and underwent a dispersing operation over a period of 3 hours and 30 minutes, and further adjusted so as to have a reducing agent concentration of 25 wt % by addition of 0.2 g of sodium salt of benzisothiazolinone and water. Thus, a dispersion of Reducing Agent-2 was obtained.

The reducing agent particles present in the thus prepared dispersion had a median diameter of 0.40 μm and the maximum diameter of 1.5 μm or below. The dispersion was passed through a polypropylene filter having a pore size of 3.0 μm to eliminate extraneous matter including dust, and then stored.

<<Preparation of Dispersion of Hydrogen Bond-Forming Compound-1>>

To 10 kg of Hydrogen Bond-Forming Compound-1 (tri (4-tert-butylphenyl)phosphine oxide) and 16 kg of a 10 wt % aqueous solution of modified polyvinyl alcohol (Poval MP-203, produced by Kuraray Co., Ltd.), 10 kg of water was added and thoroughly mixed therein to prepare a slurry.

The slurry was fed by means of a diaphragm pump into a horizontal sand mill (Model UVM-2, made by TMEX Co., Ltd.) packed with zirconia beads having an average diameter of 0.5 mm, and underwent a dispersing operation over a period of 3 hours and 30 minutes, and further adjusted so as to have a hydrogen bond-forming compound concentration of 25 wt % by addition of 0.2 g of sodium salt of benzisothiazolinone and water. Thus, a dispersion of Hydrogen Bond-Forming Compound-1 was obtained.

The hydrogen bond-forming compound particles present in the thus prepared dispersion had a median diameter of 0.35 μm and the maximum diameter of 1.5 μm or below. The dispersion was passed through a polypropylene filter having a pore size of 3.0 μm to eliminate extraneous matter including dust, and then stored.

<<Preparation of Dispersion of Development Accelerator-1>>

To 10 kg of Development Accelerator-1 and 20 kg of a 10 wt % aqueous solution of modified polyvinyl alcohol (Poval MP-203, produced by Kuraray Co., Ltd.), 10 kg of water was added and thoroughly mixed therein to prepare a slurry.

The slurry was fed by means of a diaphragm pump into a horizontal sand mill (Model UVM-2, made by IMEX Co., Ltd.) packed with zirconia beads having an average diameter of 0.5 mm, and underwent a dispersing operation over a period of 3 hours and 30 minutes, and further adjusted so as to have a development accelerator concentration of 20 wt % by addition of 0.2 g of sodium salt of benzisothiazolinone and water. Thus, a dispersion of Development Accelerator-1 was obtained.

The development accelerator particles present in the thus prepared dispersion had a median diameter of 0.48 μm and the maximum diameter of 1.4 μm or below. The dispersion was passed through a polypropylene filter having a pore size of 3.0 μm to eliminate extraneous matter including dust, and then stored.

Solid dispersions of Development Accelerator-2, Development Accelerator-3 and Tone Adjuster-1 were each prepared in the same manner as that of Development Accelerator-1. The concentration of each dispersion was 20 wt %.

(Preparation of Dispersion of Polyhalogen Compound)

<<Preparation of Dispersion of Organic Polyhalogen Compound-1>>

Ten kilogram of Organic Polyhalogen Compound-1 (tribromomethanesulfonybenzene), 10 kg of a 20 wt % water solution of modified polyvinyl alcohol (Poval MP-203, produced by Kuraray Co., Ltd.), 0.4 kg of a 20 wt % aqueous solution of sodium triisopropylnaphthalenesulfonate and 14 kg of water were thoroughly mixed together to prepare a slurry.

The slurry was fed by means of a diaphragm pump into a horizontal sand mill (Model UVM-2, made by IMEX Co., Ltd.) packed with zirconia beads having an average diameter of 0.5 mm, and subjected to a dispersing operation over a period of 5 hours, and further adjusted so as to have an organic polyhalogen compound concentration of 26 wt % by addition of 0.2 g of sodium salt of benzisothiazolinone and water. Thus, a dispersion of Organic Polyhalogen Compound-1 was obtained.

The organic polyhalogen compound particles present in the thus prepared dispersion had a median diameter of 0.41 μm and the maximum diameter of 2.0 μm or below. The dispersion was passed through a polypropylene filter having a pore size of 10.0 μm to eliminate extraneous matter including dust, and then stored.

<<Preparation of Dispersion of Organic Polyhalogen Compound-2>>

Ten kilogram of Organic Polyhalogen Compound-2 (N-butyl-3-tribromomethanesulfonylbenzamide), 20 kg of a 10 wt %aqueous solution of modified polyvinyl alcohol (Poval MP-203, produced by Kuraray Co., Ltd.) and 0.4 kg of a 20 wt % aqueous solution of sodium triisopropylnaphthalenesulfonate were thoroughly mixed together to prepare a slurry.

The slurry was fed by means of a diaphragm pump into a horizontal sand mill (Model UVM-2, made by IMEX Co., Ltd.) packed with zirconia beads having an average diameter of 0.5 mm, and subjected to a dispersing operation over a period of 5 hours, and further adjusted so as to have an organic polyhalogen compound concentration of 30 wt % by addition of 0.2 g of sodium salt of benzisothiazolinone and water. The dispersion obtained was heated at 40° C. for 5 hours. Thus, a dispersion of Organic Polyhalogen Compound-2 was obtained.

The organic polyhalogen compound particles present in the thus prepared dispersion had a median diameter of 0.40 μm and the maximum diameter of 1.3 μm or below. The dispersion was passed through a polypropylene filter having a pore size of 3.0 μm to eliminate extraneous matter including dust, and then stored.

<<Preparation of Solution of Phthalazine Compound-1>>

In 174.57 kg of water, 8 kg of modified polyvinyl alcohol (Poval MP-203, produced by Kuraray Co., Ltd.) was dissolved. Thereto were added 3.15 kg of a 20 wt % aqueous solution of sodium triisopropylnaphthalenesulfonate and 14.28 kg of a 70 wt % aqueous solution of Phthalazine Compound-1 (6-isopropylphthalazine). Thus, a 5 wt % solution of Phtahalzine Compound-1 was prepared.

(Preparation of Solution of Mercapto Compound)

<<Preparation of Aqueous Solution of Mercapto Compound-2>>

Mercapto Compound-2 (sodium salt of 1-(3-methylureido)-5-mercaptotetrazole) in an amount of 20 g was dissolved in 980 g of water to prepare a 2.0 wt % aqueous solution.

<<Preparation of SBR Latex>>

A latex of SBR with Tg of 22° C. was prepared in the following manner.

Emulsion polymerization of 70 parts by weight of styrene, 27.0 parts by weight of butadiene and 3.0 parts by weight of acrylic acid was performed in the presence of ammonium persulfate as a polymerization initiator and an anionic surfactant as an emulsifier, followed by aging at 80° C. for 8 hours. Then, the polymerization product was cooled to 40° C. and adjusted to pH 7.0 by use of aqueous ammonia. Thereto, SANDET BL produced by Sanyo Chemical Industries, Ltd. was added in an amount to reach a content of 0.22%. The pH of the resultant mixture was adjusted to 8.3 using a 5% aqueous solution of sodium hydroxide, and further to 8.4 using aqueous ammonia.

The ratio of sodium ion to ammonium ion used in the pH adjustment was 1:2.3 by mole. Then, 0.15 ml of a 7% aqueous solution of sodium salt of benzisothiazolinone was added per kg of the mixture, thereby obtaining a SBR latex.

SBR latex: Latex of -St(70.0)-Bu(27.0)-AA(3.0)-

Tg=22° C., Average particle size: 0.1 μm, concentration: 43 wt %, equilibrium water content at 25° C.-60% RH: 0.6 wt %, ionic conductivity of undiluted latex (43 wt %): 4.2 mS/cm (measured at 25° C. with a conductometer, Model CM-30S, made by DKK-TOA CORPORATION), pH: 8.4

SBR latices having different Tg values can be prepared in a similar manner described above by appropriately varying the ratio of styrene to butadiene.

<<Preparation of Coating Composition-1 for Emulsion Layer (Photosensitive Layer)>>

To 1,000 g of the foregoing dispersion of silver salt of fatty acid were added successively 276 ml of water, 3.2 g of the dispersion of Organic Polyhalogen Compound-1, 8.7 g of the dispersion of Organic Polyhalogen Compound-2, 173 g of the solution of Phthalazine Compound-1, 1,082 g of the SBR latex (Tg: 20° C.), 155 g of the dispersion of Reducing Agent-2, 55 g of the dispersion of Hydrogen Bond-Forming Compound-1, 1 g of the dispersion of Development Accelerator-1, 2 g of the dispersion of Development Accelerator-2, 3 g of the dispersion of Development Accelerator-3, 2 g of the dispersion of Tone Adjuster-1 and 6 ml of the solution of Mercapto Compound-2. Thereto, 117 g of the silver halide mixed Emulsion A was further added just before coating, and mixed thoroughly. A coating composition thus prepared for an emulsion layer was fed into a coating die without delay, and underwent coating operation.

The viscosity of the coating composition was 40 [mPa·s], measured at 40° C. (No. 1 rotor, 60 rpm) with a Brookfield type viscometer made by Tokyo Keiki Kogyo.

Further, the coating composition had viscosity values of 530, 144, 96, 51 and 28 [mPa·s] as measured at 25° C. under shear rates of 0.1, 1, 10, 100 and 1,000 [1/sec], respectively, by means of RFS Fluid Spectrometer made by Rheometrics Fareast Co. Ltd.

The content of zirconium in the coating composition was 0.25 mg per g of silver.

<Preparation of Coating Composition for Interlayer on Emulsion Side>

The coating composition for an interlayer was prepared by mixing 1,000 g of polyvinyl alcohol (PVA-205, produced by Kuraray Co., Ltd.), 272 g of a 5 wt % pigment dispersion, 4,200 ml of a 19 wt % latex of methyl methacrylate/styrene/butyl acrylate/hydroxyethyl methacrylate/acrylic acid copolymer (copolymerization ratio: 64/9/20/5/2 by weight), 27 ml of a 5 wt % aqueous solution of Aerosol OT (produced by American Cyanamid Co.) and 135 ml of a 20 wt % aqueous solution of diammonium phthalate, adding thereto water in an amount to make the total amount 10,000 g, and adjusting the pH to 7.5 by addition of NaOH. The composition thus prepared was fed into a coating die to attain a coverage of 9.1 ml/m$^2$.

The viscosity of the coating composition was 58 [mPa·s] at 40° C. (No. 1 rotor, 60 rpm) as measured with the Brookfield type viscometer.

<<Preparation of Coating Composition for First Protective Layer on Emulsion Side>>

Inert gelatin in an amount of 64 g was dissolved in water, and thereto were added 80 g of the 27.5 wt % latex of methyl methacrylate/styrene/butyl acrylate/hydroxyethyl methacrylate/acrylic acid copolymer (copolymerization ratio: 64/9/20/5/2 by weight), 23 ml of a 10 wt % methanol solution of phthalic acid, 23 ml of a 10 wt % aqueous solution of 4-methylphthalic acid, 28 ml of diluted sulfuric acid having a concentration of 0.5 mole/L, 5 ml of a 5 wt % water solution of Aerosol OT (American Cyanamid Co.), 0.5 g of phenoxyethanol and 0.1 g of benzoisothiazolinone. Further, water was added thereto in the amount to adjust the total weight of the resultant mixture to 750 g, thereby preparing a coating composition. The composition was mixed with 26 ml of a 4 wt % aqueous solution of chrome alum by means of a static mixer just before coating, and fed into a coating die to attain a coverage of 18.6 ml/m$^2$.

The viscosity of the coating composition was 20 [mPa·s] at 40° C. (No. 1 rotor, 60 rpm) as measured with the Brookfield type viscometer.

<<Preparation of Coating Composition for Second Protective Layer on Emulsion Side>>

Inert gelatin in an amount of 80 g was dissolved in water, and thereto were added 102 g of a 27.5 wt % latex of methyl methacrylate/styrene/butyl acrylate/hydroxyethyl methacrylate/acrylic acid copolymer (copolymerization ratio: 64/9/20/5/2 by weight), 3.2 ml of a 5 wt % aqueous solution of fluorine-containing surfactant (F-1: potassium salt of N-perfluorooctylsulfonyl-N-propylalanine), 32 ml of a 2 wt % water solution of fluorine-containing surfactant (F-2: polyethylene glycol mono (N-perfluorooctylsulfonyl-N-propyl-2-aminoethyl) ether [average polymerization degree of ethylene oxide=15]), 3 ml of a 5 wt % solution of fluorine-containing surfactant F-5, 10 ml of a 2% solution of fluorine-containing surfactant F-6, 23 ml of a 5 wt % solution of Aerosol OT (American Cyanamid Co.), 4 g of particulate polymethyl methacrylate (average particle size: 0.7 μm), 21 g of particulate polymethyl methacrylate (average particle size: 4.5 μm), 1.6 g of 4-methylphthalic acid, 4.8 g of phthalic acid, 44 ml of diluted sulfuric acid having a concentration of 0.5 mole/Land 10 mg of benzoisothiazolinone. Further, water was added thereto in the amount to adjust the total weight to 650 g and, just before coating, mixed with 445 ml of aqueous solution containing 4 wt % chrome alum and 0.67 wt % of phthalic acid by means of a static mixer, thereby preparing a coating composition for a second protective layer on the emulsion side. The composition was fed into a coating die to attain a coverage of 8.3 ml/m$^2$.

The viscosity of the coating composition was 19 [mPa·s] at 40° C. (No. 1 rotor, 60 rpm) as measured with the Brookfield type viscometer.

<<Production of Heat-Developable Photosensitive Material-1>>

On the back side of the support provided with the undercoat layers, the coating composition for an antihalation layer and the coating composition for the back protective layer were coated so as to have an absorption of 0.3 at 504 nm and a gelatin coverage of 1.7 g/m$^2$ respectively by the use of a simultaneous double coating method, and then dried to prepare a backing layer.

On the undercoat side opposite to the backside of the support, the emulsion layer, the interlayer, the first protective layer and the second protective layer were coated simultaneously in this order using a slide bead coating method, thereby producing a sample heat-developable photosensitive material. Herein, the temperature of the emulsion layer and the interlayer was adjusted to 31° C., that of the first protective layer to 36° C., and that of the second protective layer to 37° C.

The coverage (g/m$^2$) of each ingredient in the emulsion layer was described below:

| | |
|---|---|
| Silver behenate | 5.55 |
| Polyhalogen Compound-1 | 0.02 |
| Polyhalogen Compound-2 | 0.06 |
| Phthalazine Compound-1 | 0.19 |
| SBR latex | 9.67 |
| Reducing Agent-2 | 0.81 |
| Hydrogen Bond-Forming Compound-1 | 0.30 |
| Development Accelerator-1 | 0.004 |
| Development Accelerator-2 | 0.010 |
| Development Accelerator-3 | 0.015 |
| Tone Adjuster-1 | 0.010 |
| Mercapto Compound-2 | 0.002 |
| Silver halide (as silver) | 0.091 |

The following were coating and drying conditions adopted therein.

The coating operation was carried out at a speed of 160 m/min, the clearance between the tip of the coating die and the support was chosen from the range of 0.10 to 0.30 mm, and the pressure of the vacuum chamber was controlled so as to be from 196 to 882 Pa lower than atmospheric pressure. Prior to coating, static charge of the support was eliminated by ion wind.

In the chilling zone subsequent to the coating zone, the air having a dry-bulb temperature of 10–20° C. was made to blow against the coated layers to effect the chilling. Thereafter, the support with the coated layers was conveyed in a contact-free condition, and dried by blowing drying air having a dry-bulb temperature of 23–45° C. and a wet-bulb temperature of 15–21° C. using a helical non-contact dryer.

After the drying, the coated layers underwent moisture adjustment at 25° C. under humidity of 40–60% RH, and then heated up to 70–90° C., followed by cooling to 25° C.

The mattness of the heat-developable photosensitive material thus produced was 550 seconds on the photosensitive layer side and 130 seconds on the back layer side in terms of Bekk smoothness.

The chemical structures of the compounds used in the examples are illustrated below:

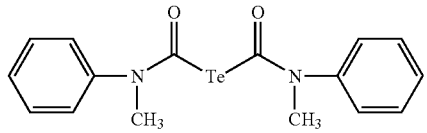

Tellurium Sensitizer C

-continued
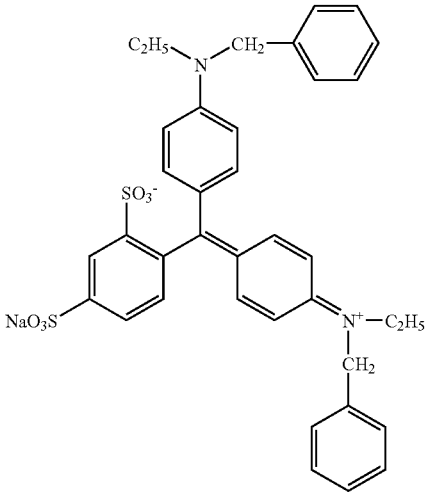
Blue Dye Compound-1
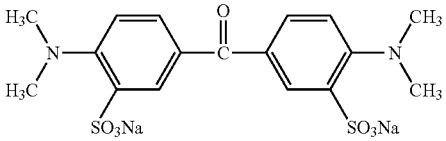
Yellow Dye Compound-1
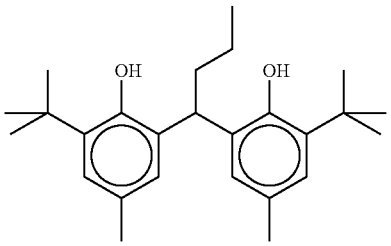
Reducing Agent-2
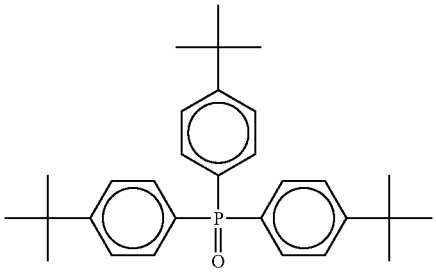
Hydrogen Bond-Forming Compound-1
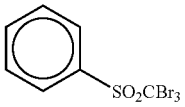
Polyhalogen Compound-1
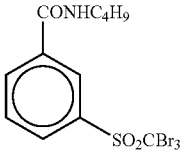
Polyhalogen Compound-2
-continued
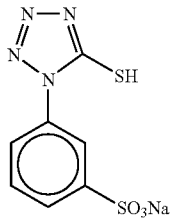
Mercapto Compound-1
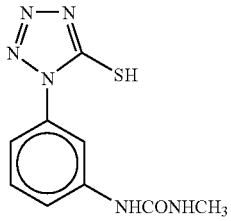
Mercapto Compound-2
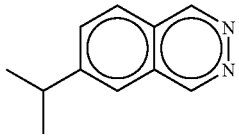
Phthalazine Compound-1
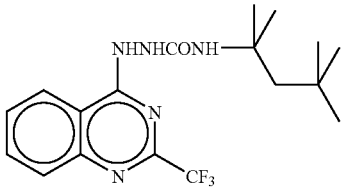
Development Accelerator-1
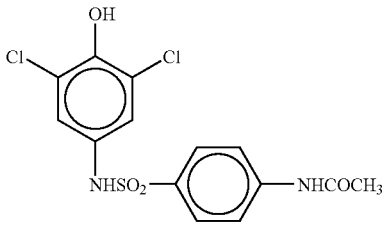
Development Accelerator-2
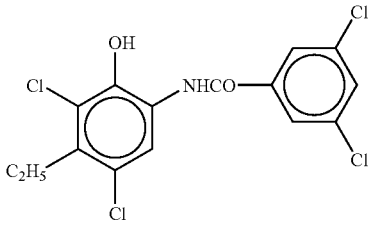
Development Accelerator-3

-continued

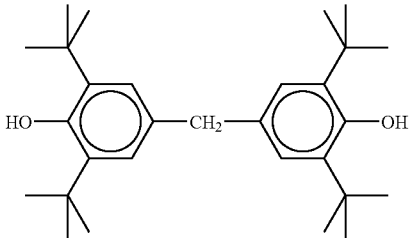

Tone Adjuster-1

F-1 $C_8F_{17}SO_2-N(C_3H_7(n))-CH_2COOK$

F-2 $C_8F_{17}SO_2-N(C_3H_7(n))-CH_2CH_2O-(CH_2CH_2O)_n-H$ n = 15 (average value)

F-3 $C_8F_{17}SO_2-N(C_3H_7(n))-(CH_2CH_2O)_4-CH_2CH_2CH_2CH_2SO_3Na$

F-4 $C_8F_{17}SO_3K$

F-5 $CF_3(CF_2)nCH_2CH_2SCH_2CH_2COOLi$ a mixture of the compounds with n = 5–11

F-6 $CF_3(CF_2)nCH_2CH_2O(CH_2CH_2O)mH$ a mixture of the compounds with n = 5–11 and m = 5–15

F-7 $CF_3(CF_2)nCH_2CH_2SO_3Na$ a mixture of the compounds with n = 5–11

F-8 $C_6F_{13}CH_2CH_2SO_3Li$ (Preparation for Evaluation of Photographic Properties)

The sample material obtained was cut into sheets measuring 356 mm by 432 mm, wrapped in the following wrapping material in surroundings of 25° C. and 50% RH, and stored for 2 weeks at room temperature.

(Wrapping Material)

A laminate of 10 μm-thick PET, 12 μm-thick PE, 9 μm-thick Al, 15 μm-thick Ny and 50 μm-thick polyethylene containing 3% carbon black Oxygen permeability: 0 ml/atm·$m^2$·25° C.·day Moisture permeability: 0 g/atm·$m^2$·25° C.·day Experiment 2: Production of Heat-Developable Photosensitive Material 2

<<Preparation of Silver Halide Emulsion 2>>

A solution prepared by adding 4.3 ml of a 1 wt % potassium iodide solution to 1,420 ml of distilled water and then adding thereto 3.5 ml of diluted sulfuric acid with a concentration of 0.5 mole/L and 36.7 g of phthalated gelatin was placed in a reaction pot made of stainless steel, and kept at 42° C. with stirring. Thereto, Solution A prepared by diluting 74.08 g of silver nitrate to 649.9 ml with distilled water and Solution B prepared by diluting 80 g of potassium iodide to 800 ml with distilled water were added at constant flow rates in their entirety over a 100-minute period.

After a lapse of 10 minutes from the addition of Solutions A and B, 10 ml of a 3.5 wt % aqueous solution of hydrogen peroxide and 10.8 ml of a 10 wt % aqueous solution of benzimidazole were added. After a further lapse of 10 minutes, potassium hexachloroiridate(III) in an amount of $1\times10^{-4}$ mole per mole of silver was further added at once. Furthermore, after a 5-second lapse from the completion of addition of Solution A, an aqueous solution of potassium iron(II) hexacyanide in an amount of $3\times10^{-4}$ mole per mole of silver was added at once.

The pH of the resultant reaction mixture was adjusted to 3.8 by the use of diluted sulfuric acid having a concentration of 0.5 mole/L. At this point the reaction mixture ceased to be stirred, and it was subjected successively to precipitation, desalting and washing operations. In addition, the pH 1 adjustment to 5.9 was carried out by addition of an aqueous solution of NaOH having a concentration of 1 mole/L. Thus, a silver halide dispersion was prepared.

The silver halide dispersion was kept at 38° C. with stirring and mixed with 5 ml of a 0.34 wt % methanol solution of 1,2-benzisothiazoline-3-one. After a 1-minute lapse, the temperature of the dispersion was raised to 47° C. After a 20-minute lapse from the temperature raise, a methanol solution of sodium benzenethiosulfonate was added in an amount of $7.6\times10^{-5}$ mole/mole silver. After a further lapse of 5 minutes, tellurium sensitizer C as a methanol solution was added thereto in an amount of $2.9\times10^{-4}$ mole per mole of silver. The resulting dispersion was ripened for 91 minutes.

The thus ripened dispersion was mixed with 1.3 ml of a 0.8 wt % methanol solution of N,N'-dihydroxy-N"-diethylmelamine. Thereto, after a 4-minute lapse, were further added $4.8\times10^{-3}$ mole/mole silver of 5-methyl-2-mercaptobenzimidazole as a methanol solution and $5.4\times10^{-3}$ mole/mole silver of 1-phenyl-2-heptyl-5-mercapto-1,3,4-triazole as a methanol solution and $8.5\times10^{-3}$ mole/mole silver of sodium 1-(3-methylureido)-5-mercaptotetrazole as an aqueous solution. Thus, a silver halide Emulsion 2 was obtained.

The grains in the thus prepared silver halide emulsion were pure silver iodide grains having an average sphere equivalent diameter of 0.040 μm and a variation coefficient of 20% with respect to sphere equivalent diameter.

A heat-developable Photosensitive Material 2 was produced under the same conditions as in Experiment 1, except that the silver halide Emulsion 2 was used.

Experiment 3: Production of Heat-Developable Photosensitive Material 3

<<Preparation of Silver Halide Emulsion 3>>

A solution prepared by adding 3.1 ml of a 1 wt % potassium iodide solution to 1,421 ml of distilled water and further adding thereto 3.5 ml of diluted sulfuric acid with a concentration of 0.5 mole/L and 31.7 g of phthalated gelatin was placed in a reaction pot made of stainless steel, and kept at 34° C. with stirring. Thereto, Solution A prepared by diluting 74.08 g of silver nitrate to 649.9 ml with distilled water was added at a constant flow rate in its entirety over a 100-minute period and Solution B prepared by diluting 80 g of potassium iodide to 800 ml with distilled water was added in accordance with CDJ method while keeping the pAg at 10.0.

After a lapse of 10 minutes from the addition of Solutions A and B, 10 ml of a 3.5 wt % aqueous solution of hydrogen peroxide and 10.8 ml of a 10 wt % aqueous solution of benzimidazole were added. After a further lapse of 10 minutes, potassium hexachloroiridate(III) in an amount of $1\times10^{-4}$ mole per mole of silver was further added in its entirety. Furthermore, after a 5-second lapse from the completion of addition of Solution A, an aqueous solution of potassium iron(II) hexacyanide in an amount of $3\times10^{-4}$ mole per mole of silver was added in its entirety.

The pH of the resultant reaction mixture was adjusted to 3.8 by use of diluted sulfuric acid having a concentration of 0.5 mole/L. At this point the reaction mixture ceased to be stirred, and it was subjected successively to precipitation, desalting and washing operations. In addition, the pH adjustment to 5.9 was carried out by addition of an aqueous solution of NaOH having a concentration of 1 mole/L. Thus, a silver halide dispersion of pAg 8.0 was prepared.

The silver halide dispersion thus prepared was treated under the same conditions as in Experiment 1, thereby preparing a silver halide Emulsion 3 having an average γ-phase proportion of 5%.

The grains in the thus prepared silver halide emulsion were pure silver iodide grains having an average sphere equivalent diameter of 0.040 μm and a variation coefficient of 18% with respect to sphere equivalent diameter.

A heat-developable Photosensitive Material 3 was produced under the same conditions as in Experiment 1, except that the silver halide Emulsion 3 was used.

Experiments 4 to 6: Production of Heat-Developable Photo-Sensitive Materials 4, 5 and 6

<<Preparation of Silver Halide Emulsions 4, 5 and 6>>

Silver halide Emulsions 4, 5 and 6 were each prepared in the same manner as in Experiment 3, except that the pAg kept throughout the period during which Solution B was added in accordance with CDJ method was 7.4 in the case of Emulsion 4, 6.3 in the case of Emulsion 5 and 3.3 in the case of Emulsion 6. Each of these emulsions had an average γ-phase proportion as set forth in Table 1. Photosensitive Materials 4, 5 and 6 were produced using these Emulsions 4, 5 and 6, respectively. Herein, the sizes of silver halide grains were adjusted to have an average sphere equivalent diameter of 0.040 μm by varying the temperature at which silver halide grains were formed.

Experiment 7: Production of Heat-Developable Photosensitive Material 7

<<Preparation of Silver Halide Emulsion 7>>

A silver halide emulsion having a uniform halide composition containing 5% bromide was prepared in the same manner as the silver halide Emulsion 4 in Experiment 4, except that the halide added was changed in composition. By using the thus prepared emulsion, photosensitive Material 7 was produced.

Herein also, the sizes of silver halide grains were adjusted to have an average sphere equivalent diameter of 0.040 μm by varying the temperature at which silver halide grains were formed.

(Evaluations of Heat-Developable Photosensitive Materials 1 to 7)

Photosensitive Materials 1 to 7 produced in Experiments 1 to 7, respectively, were evaluated as follows.

<Exposure of Photosensitive Material>

Each of the photosensitive materials produced in Experiments 1 to 7 was subjected to exposure as described below.

In an exposure section of Fuji Medical Dry Laser Imager FM-DPL, semiconductor laser, NLHV3000E, produced by NICHIA CORPORATION was mounted as a light source, and the beam diameter thereof was focused to about 100 μm. Each photosensitive material underwent $10^{-6}$-second exposure to the laser light in the illuminance varied between 0 and 1 to 1,000 mW/mm$^2$. The wavelength of light emitted from the semiconductor laser was 405 nm.

<Development of Photosensitive Material>

The thus exposed photosensitive materials were each subjected to heat development under the following conditions.

In a heat-development section of Fuji Medical Dry Laser Imager FM-DPL, heat development was performed under conditions that 4 built-in panel heaters were set at 112° C., 114° C., 116° C. and 118° C., respectively, and the total heat-development time was adjusted to 14 seconds by increasing the speed of film conveyance.

<Evaluation of Sample>

The density of the image obtained was measured with a densitometer, and a characteristic curve was prepared by plotting the density as ordinate and the logarithm of exposure amount as abscissa. The optical density of unexposed area was defined as fog, and the reciprocal of the exposure amount required for providing the optical density of 2.0 was defined as sensitivity. The sensitivity shown in Table 1 is relative value, with Photosensitive Material 2 being taken as 100. The exposure was carried out under each of temperatures 13° C. and 32° C., and the sensitivity was determined in each of these exposure conditions.

The results obtained are shown in Table 1.

TABLE 1

| Experiment No. | Photo-sensitive material | Wavelength of exposure laser (nm) | Iodide content (%) | Bromide content (%) | γ-Phase proportion (%) | Size of silver halide grains | Amount of phthalazine compound (mol/mol Ag) | Sensitivity (exposure temperature of 13° C.) | Sensitivity (exposure temperature of 32° C.) | Fog | Note |
|---|---|---|---|---|---|---|---|---|---|---|---|
| 1 | 1 | 405 | 3.5 | 96.5 | 0 | 40 nm | 1.27 | 30 | 34 | 0.33 | Comparison |
| 2 | 2 | " | 100 | 0 | 0 | " | " | 100 | 109 | 0.16 | Comparison |
| 3 | 3 | " | 100 | 0 | 5 | " | " | 98 | 101 | 0.16 | Invention |
| 4 | 4 | " | 100 | 0 | 25 | " | " | 96 | 97 | 0.17 | Invention |
| 5 | 5 | " | 100 | 0 | 40 | " | " | 96 | 96 | 0.17 | Invention |
| 6 | 6 | " | 100 | 0 | 65 | " | " | 92 | 94 | 0.17 | Invention |
| 7 | 7 | " | 95 | 5 | 25 | " | " | 95 | 96 | 0.18 | Invention |

It can be said that as the ratio between the sensitivity obtained by the exposure at temperature of 13° C. and the sensitivity obtained by the exposure at temperature 32° C. is closer to 1, the stability in sensitivity becomes higher. As can be seen from Table 1, the photosensitive materials according to the invention have high sensitivity and low tog, and they exhibit a very small sensitivity difference caused by change of the temperature at the exposure.

EXAMPLE 2

(Production and Evaluation of Heat-Developable Photosensitive Materials 8 to 15)

Photosensitive materials 8 to 15 were produced in the same manner as in Experiment 1, except that the silver halide Emulsion 1 prepared in Experiment 1 of Example 1 or the silver halide Emulsion 4 prepared in Experiment 4 of Example 1 was used and that the amount of the phthalazine compound to the silver halide in the emulsion layer was changed as set forth in Table 2.

In the same manner as in Example 1, the evaluations of photographic properties were performed on these photosensitive materials in addition to Photosensitive Materials 1 and 4. The sensitivity set forth in Table 2 is a relative value, with Photosensitive Material 4 exposed under the temperature of 13° C. being taken as 100.

The results obtained are shown in Table 2.

As can be seen from Table 2, the sensitivity difference attributed to the temperature at the exposure is minimized by combining the silver halide emulsion containing a high silver iodide content γ-phase and an appropriate amount of phthalazine compound. When the amount of phthalazine compound incorporated in the emulsion layer containing silver halide other than the high silver iodide content silver halide is greater than 5 moles per mole of silver (as in the case of Photosensitive Material 15), the fog becomes so high that it is difficult to properly determine the sensitivity difference attributed to the temperature at which exposure is performed.

EXAMPLE 3

(Evaluation of Heat-Developable Photosensitive Materials 1 to 7 Under Low Illuminance Exposure)

Exposure was performed in the same manner as in Example 1, except that each of Photosensitive Materials 1 to 7 was exposed to a 1 KW tungsten light via a 405 nm interference filter. As the illuminance was remarkably weakened by a stepwedge to 0 and 0.001 to 0.1 mW/m$^2$, compared with the illuminance of the exposure in Example 1, the exposure time was adjusted to attain the necessary optical density. The sensitivity set forth in Table 3 is a relative value, with Photosensitive Material 2 being taken as 100.

The results obtained are shown in Table 3.

TABLE 2

| Experiment No. | Photo-sensitive material | Wavelength of exposure laser (nm) | Iodide content (%) | Bromide content (%) | γ-Phase proportion (%) | Size of silver halide grains | Amount of phthalazine compound (mol/mol Ag) | Sensitivity (exposure temperature of 13° C.) | Sensitivity (exposure temperature of 32° C.) | Fog | Note |
|---|---|---|---|---|---|---|---|---|---|---|---|
| 8 | 8 | 405 | 100 | 0 | 25 | 40 nm | 0.13 | 83 | 89 | 0.10 | Invention |
| 9 | 9 | " | " | " | " | " | 0.25 | 91 | 94 | 0.14 | Invention |
| 10 | 10 | " | " | " | " | " | 0.64 | 94 | 96 | 0.15 | Invention |
| 11 | 4 | " | " | " | " | " | 1.27 | 100 | 101 | 0.17 | Invention |
| 12 | 11 | " | " | " | " | " | 6.35 | 104 | 105 | 0.35 | Intention |
| 13 | 12 | " | 3.5 | 96.5 | 0 | " | 0.13 | 21 | 28 | 0.13 | Comparison |
| 14 | 13 | " | " | " | " | " | 0.25 | 25 | 29 | 1.22 | Comparison |
| 15 | 14 | " | " | " | " | " | 0.64 | 27 | 32 | 0.27 | Comparison |
| 16 | 1 | " | " | " | " | " | 1.27 | 29 | 34 | 0.33 | Comparison |
| 17 | 15 | " | " | " | " | " | 6.35 | 31 | 34 | 0.51 | Comparison |

TABLE 3

| Experiment No. | Photo-sensitive Material | Wavelength of exposure laser (nm) | Iodide content (%) | Bromide content (%) | γ-Phase proportion (%) | Size of silver halide grains | Amount of phthalazine compound (mol/mol Ag) | Sensitivity (exposure temperature of 13° C.) | Sensitivity (exposure temperature of 32° C.) | Fog | Note |
|---|---|---|---|---|---|---|---|---|---|---|---|
| 18 | 1 | 405 | 3.5 | 96.5 | 0 | 40 nm | 1.27 | 625 | 673 | 0.33 | Comparison |
| 19 | 2 | " | 100 | 0 | 0 | " | " | 100 | 110 | 0.16 | Comparison |
| 20 | 3 | " | 100 | 0 | 5 | " | " | 98 | 102 | 0.17 | Invention |
| 21 | 4 | " | 100 | 0 | 25 | " | " | 95 | 97 | 0.17 | Invention |
| 22 | 5 | " | 100 | 0 | 40 | " | " | 94 | 96 | 0.17 | Invention |
| 23 | 6 | " | 100 | 0 | 65 | " | " | 94 | 97 | 0.17 | Invention |
| 24 | 7 | " | 95 | 5 | 25 | " | " | 96 | 97 | 0.18 | Invention |

As can be seen from the comparison of the results shown in Table 1 and Table 3, the present photosensitive materials can achieve more desirable characteristics with respect to the sensitivity stability in the case of the exposure of high illuminance than in the case of exposure of low illuminance.

EXAMPLE 4

The photosensitive materials were each evaluated in the same way as in Example 1, except that a laser device emitting light with a wavelength of 395 nm was used. The photosensitive materials according to the invention also provided the preferred results.

In accordance with the invention, the heat-developable photosensitive material can ensure high sensitivity, high image quality, and excellent stability in sensitivity without affected by temperature at the time of exposure, though it is a high silver iodide content silver halide photosensitive material. Further, an image formation method using the photosensitive material can be provided.

The entire disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A heat developable photosensitive material comprising light-sensitive silver halide, a light-insensitive organic silver salt, a reducing agent and a binder selected from acrylic polymer, polyester, rubber, polyurethane, polyvinyl chloride, polyvinyl acetate, polyvinylidene chloride and polyolefin on a support, wherein at least 30 mole % of the total light-sensitive silver halide is silver halide of high silver iodide content having an average γ-phase proportion of from 5 to 70 mole %.

2. A heat-developable photosensitive material as claimed in claim 1, which further comprises a compound represented by the following formula (1) in a content of from 0.2 to 5 moles per mole of the light-sensitive silver halide on the same side as the light-sensitive silver halide on the support:

(1)

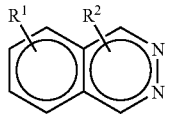

wherein $R^1$ and $R^2$ each independently represent a hydrogen atom or a group capable of substituting on the benzene ring.

3. A heat-developable photosensitive material as claimed in claim 1, wherein the light-sensitive silver halide is silver halide formed in the absence of a light-insensitive organic silver salt.

4. A heat-developable photosensitive material as claimed in claim 1, wherein at least 30 mole % of the total light-sensitive silver halide is silver halide of high silver iodide content having an average γ-phase proportion of from 10 to 50 mole %.

5. A method of forming images comprising exposing the heat-developable photosensitive material as claimed in claim 1 using as a light source a semiconductor laser having a peak of light-emission strength in the wavelength region of 350 to 450 nm.

6. A method of forming images comprising exposing the heat-developable photosensitive material as claimed in claim 1 using as a light source a semiconductor laser having a peak of light-emission strength in the wavelength region of 390 to 430 nm.

* * * * *